US005727634A

United States Patent [19]

Ishida et al.

[11] Patent Number: 5,727,634

[45] Date of Patent: Mar. 17, 1998

[54] FIRE DETECTING/EXTINGUISHING APPARATUS AND WATER DISCHARGING NOZZLE THEREFOR

[75] Inventors: Hiroshi Ishida; Akira Asoma; Shuji Matsumoto; Teruo Iwata; Hiroyuki Shibuya; Suguru Shimokawa; Keiichi Kawaguchi, all of Tokyo; Masaru Fujita; Toshiaki Matsumoto, both of Osaka, all of Japan

[73] Assignee: Hochiki Corporation, Tokyo, Japan

[21] Appl. No.: 506,981

[22] Filed: Jul. 28, 1995

[30] Foreign Application Priority Data

| | | | |
|---|---|---|---|
| Jul. 29, 1994 | [JP] | Japan | 6-178244 |
| Jul. 29, 1994 | [JP] | Japan | 6-178245 |
| Jul. 29, 1994 | [JP] | Japan | 6-178246 |
| Dec. 26, 1994 | [JP] | Japan | 6-321999 |
| May 12, 1995 | [JP] | Japan | 7-114339 |

[51] Int. Cl.[6] ..... A62C 37/40

[52] U.S. Cl. ..... 169/60; 169/61

[58] Field of Search ..... 169/60, 61; 340/577, 340/578; 250/339.15, 342, 554, 559.14, 559.37

[56] References Cited

U.S. PATENT DOCUMENTS

| | | | |
|---|---|---|---|
| 4,671,362 | 6/1987 | Odashima | 169/61 |
| 4,801,090 | 1/1989 | Yoshida et al. | 239/290 |
| 4,821,805 | 4/1989 | Saito et al. | 169/61 X |
| 4,909,329 | 3/1990 | Yoshida et al. | 169/61 |
| 5,392,990 | 2/1995 | Iwata et al. | 239/232 |
| 5,548,276 | 8/1996 | Thomas | 340/578 |

FOREIGN PATENT DOCUMENTS

| | | |
|---|---|---|
| 5-54997 | 8/1993 | Japan . |
| 2173100 | 10/1986 | United Kingdom . |

*Primary Examiner*—Andrew C. Pike

*Attorney, Agent, or Firm*—Sughrue, Mion, Zinn, Macpeak & Seas, PLLC

[57] ABSTRACT

A fire detecting/extinguishing apparatus according to the present invention is comprised of a fire detecting unit which monitors to detect a fire within a monitoring area, the fire detecting unit stepwise scanning in a vertical direction while scanning the fire monitoring area in the vertical direction at each step of the horizontal scanning; a water discharging unit having a water discharging nozzle for discharging water to the monitoring area, the water discharging unit being rotatable in the horizontal direction, the water discharging unit being directed toward a position of the fire based on the fire detection by the fire detecting unit; a swinging unit which swings the water discharging unit in the horizontal direction; and a casing in which the fire detecting unit and the water discharging unit are housed as a single unit. Further, the apparatus of the present invention includes a cover fixed to a side of the water discharging nozzle which is opposite to the side of the water discharging nozzle. The cover is capable of rotating together with the water discharging unit, and the cover is flush with a front wall of the casing when the water discharging nozzle is housed in the casing.

36 Claims, 18 Drawing Sheets

| H | θv |
|---|---|
| 4m | 75° |
| 5m | 73° |
| 6m | 71° |
| | |

FIRE DETECTING/EXTINGUISHING APPARATUS AND WATER DISCHARGING NOZZLE THEREFOR

BACKGROUND OF THE INVENTION

1. Field of the Invention

The present invention relates to a fire detecting/extinguishing apparatus of the type in which a fire detector and a water discharging nozzle are constructed in a single unit. In particular, the apparatus and nozzle are used for detecting and extinguishing a fire at short range therefrom.

2. Description of the Background Art

In a fire detecting/extinguishing apparatus having a long water-discharging distance, e.g., 50 or 60 m, a water discharging nozzle is also large in size. A drive mechanism for driving the water discharging nozzle is also large. Accordingly, the water discharging nozzle and the fire detector are constructed separately. On the other hand, in the fire detecting/extinguishing apparatus having a water-discharging distance about 20 m, the water discharging nozzle and its drive mechanism are both small in size. Accordingly, the fire detector and the water discharging nozzle are integrally constructed in a single unit. This unit may be installed on a wall (U.S. Pat. No. 4,801,090 and U.S. Pat. No. 5,392,990).

The fire detecting/extinguishing apparatus in which the fire detector and the water discharging nozzle are constructed to be integrated in a single unit may be reduced in size. Consequently, it is often installed on a place of a structure where it can be seen. However, if such a small fire detecting/extinguishing apparatus exposes its water discharging nozzle, it may spoil the appearance of the wall on which it is mounted.

One of the conceivable ways to solve the problem is to cover the water discharging nozzle with a cover that may be opened and closed. In this case, since a mechanism is necessary for opening the cover when water is discharged, the structure of the apparatus is made complicated. Further, if the opening/closing mechanism malfunctions, water cannot be discharged at the time of a fire so as to extinguish the fire.

In addition, there is known a conventional fire detecting/extinguishing apparatus in which a detector and water discharge nozzle are integrated as a single unit. In such an apparatus, the fire detector is capable of detecting a fire in a vertical direction in a range from a position beneath the detector to a position at a predetermined angle θ therefrom, and the water discharge nozzle having a predetermined water-discharging pattern is capable of swinging in a horizontal direction. However, as shown in FIG. 15, when the apparatus installed on a location of a height H (for example, 4 m high) from the floor level and is installed again at another higher location (for example, 6 m high), the water-discharging pattern, in particular, the water-discharging distance, falls short of covering the full fire monitoring range defined by a preset scan angle. In this case, the discharged water fails to reach a part D' of the full monitoring range of the fire detector from the higher location.

Further, in the large fire detecting/extinguishing apparatus, the fire detector and the water discharging nozzle are separately provided. Accordingly, the position of a flame has to be calculated in accordance with a signal from the fire detector so that the water discharging nozzle is controlled to swing in a horizontal direction and direct water toward the flame. The water-discharging nozzle is then swung so as to direct toward the flame based on the calculated position. Further, in order to obtain the swinging angle of the water-discharging nozzle, for example, a rotary encoder is used to confirm as to whether or not the water-discharging nozzle is directing water toward the flame. As a result, in the apparatus, the calculation is complicated, and the expensive rotary encoder has to be employed. (U.S. Pat. No. 4,909,329).

On the other hand, as a short-range water discharging nozzle structure, there is known "Very Short-Range Water Discharging Nozzle", disclosed in Published Examined Japanese Patent Publication (Kokohu) 5-54997, and as shown in FIG. 30.

In the conventional water discharging nozzle shown in FIG. 30, pressurized water is supplied to a current tube 11, and to a nozzle tube 13. Current plates 12 control the rotation of a stream of water passing therethrough. The water passes through openings in a rod mounting portion 14 which secures a rod 15 to the current tube 11, and is discharged along the rod 15 from the nozzle tube 13. The discharged water is scattered by a die member 16 attached to the top end of the rod, and a part of the discharged water is reflected sideways by deflector arms 18 and 17. The water streams scattered by the deflector arms 17 are further scattered toward the nozzle tube 13 by rearwardly bent parts 17*a*, which are formed by rearwardly bending the end part of the deflector arms 17.

The water discharging nozzle thus constructed provides a gourd shaped effective water-sprinkling area ranging from the installed place of the nozzle to positions distanced about 18 m therefrom. The nozzle is capable of effectively extinguishing a fire in the vicinity of the nozzle.

In the conventional short-range water discharging nozzle, a short-range effective sprinkle range is secured by disposing the deflectors in front of the nozzle tube. This construction necessitates a complexity of the structure and an increased number of components of the nozzle.

Usually, the conventional short-range water discharging nozzle is used in combination with a long-range water discharging nozzle for extinguishing fire in a large space. The pressure applied to the water supplied from an extinguishing pump equipment is sufficiently high, e.g., 8 25 kgf/cm$^2$. Accordingly, the quantity of discharging water is great.

In a case where the short-range water discharging nozzle is solely installed for a fire protection space which is relatively small, a short range extinguishing pump is used to maintain the pressure of the discharging water at a relatively low level, e.g., 2.5 Kg$_f$/cm$^2$, for example, and the quantity of discharged water is thus small. Typically, a low cost extinguishing pump which allows for minimum water damage is used. In the extinguishing pump which provides low-pressure/low flow rate, the velocity of the stream discharged from the nozzle is low. As a result, the deflectors insufficiently sprinkle water, and the resultant effective sprinkle range is unsatisfactory.

SUMMARY OF THE INVENTION

It is an object of the present invention to provide a fire detecting/extinguishing apparatus which keeps the water discharging nozzle from sight by using a cover and a simple mechanism in a normal situation so as not to damage the beauty of the appearance, and directs the nozzle to outside to be ready for the water discharging when a fire occurs.

The fire detecting/extinguishing apparatus of the present invention is comprised of a fire detecting unit which monitors to detect an occurrence of a fire within a monitoring area. The fire detecting unit scans stepwise in a vertical direction while scanning the fire monitoring area in the vertical direction at each step of the horizontal scanning. The apparatus further includes a water discharging unit having a water discharging nozzle for discharging water to the monitoring area. The water discharging unit is rotatable in the horizontal direction so as to be directed toward a position of the fire based on the fire detection by the fire detecting unit. A swinging unit swings the water discharging unit in the horizontal direction, and a main unit case in which the fire detecting unit and the water discharging unit are housed as a single unit. Further, the apparatus of the present invention includes a cover fixed to a side of the water discharging nozzle where is opposite to the side of the water discharging nozzle. The cover is capable of rotating together with the water discharging unit, and the cover is flush with a front wall of the main unit case when the water discharging nozzle is housed in the main unit case.

Accordingly, in a normal situation, the fire detecting/extinguishing apparatus can perfectly keep the water discharging nozzle from sight by a cover without damaging the beauty of the appearance. When a fire occurs, the nozzle is exposed to the outside and directed toward the fire direction to be ready for the water discharging by the simple mechanism.

DETAILED DESCRIPTION OF THE PREFERRED EMBODIMENTS

Preferred embodiments of the present invention will be described referring to the accompanying drawings as follows.

Figure 1:
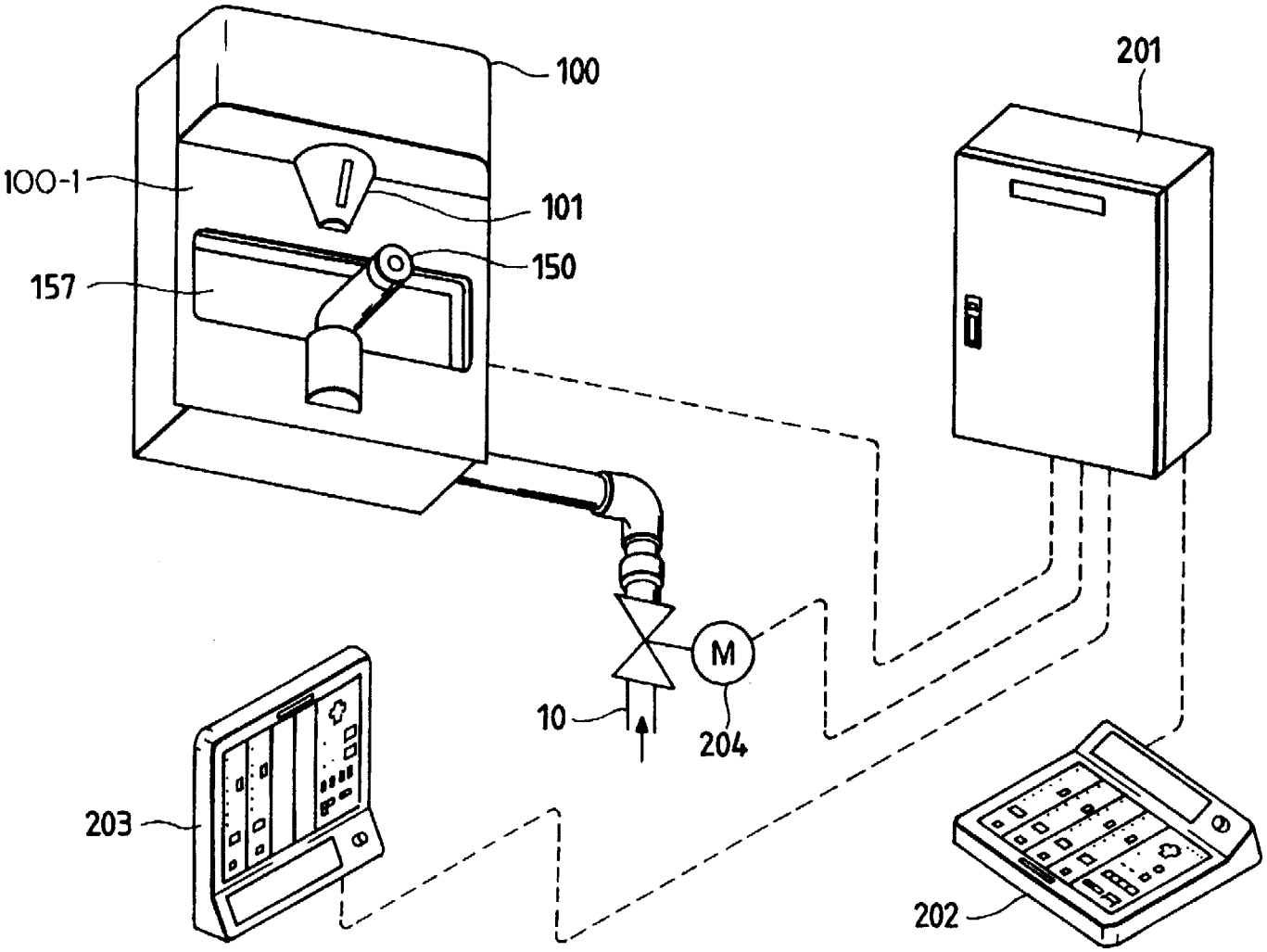
FIG. 1 is a view showing a system including a fire detecting/extinguishing apparatus according to the present invention.

First embodiment of a fire detecting/extinguishing apparatus of the present invention will be described as follows. FIG. 1 is a view showing a system including the fire detecting/extinguishing apparatus according to the present invention.

Figure 2:
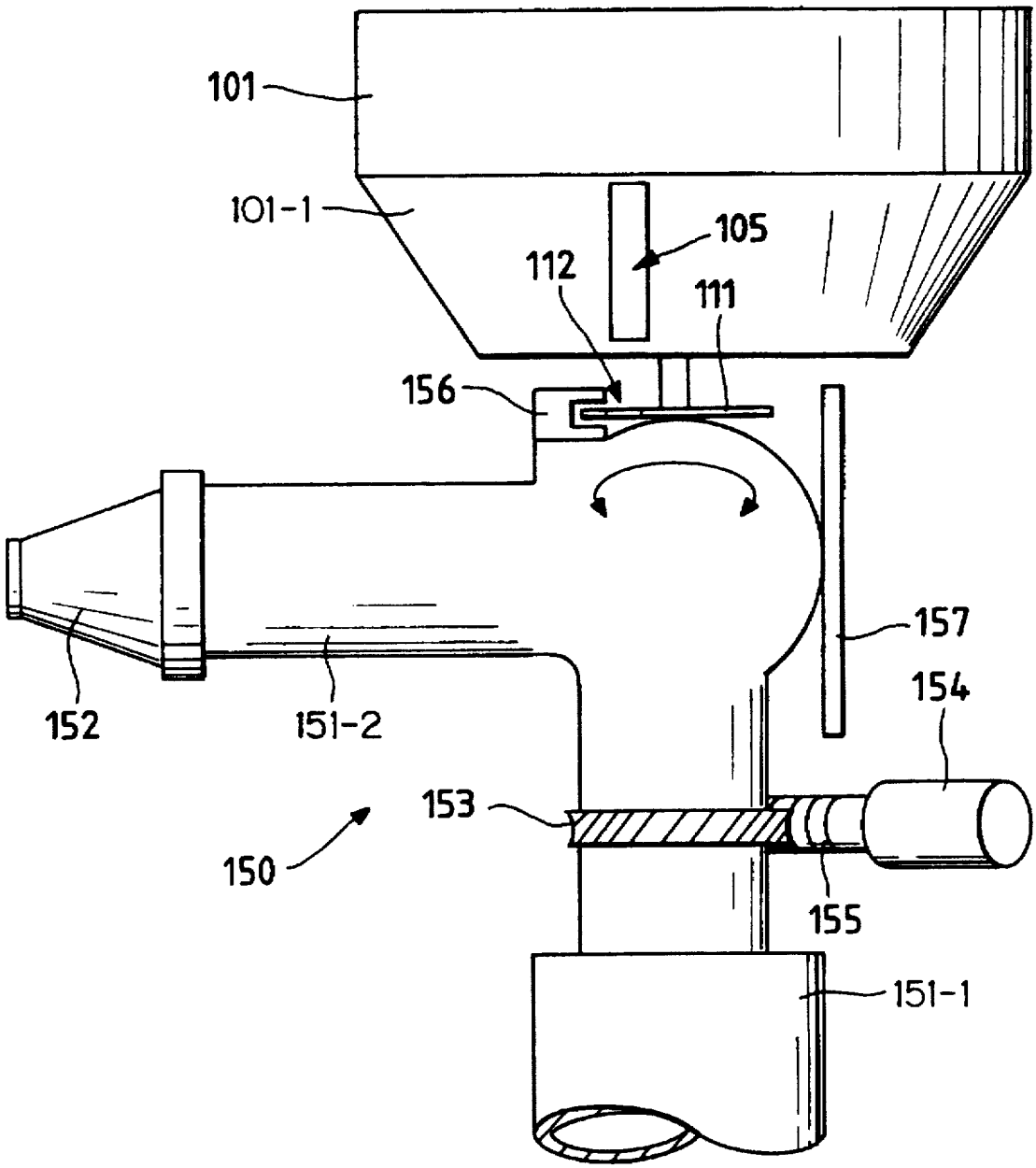
FIG. 2 is a side view showing a structural relationship between a fire detecting unit and a water-discharging nozzle in a first and a second embodiment of the fire detecting/extinguishing apparatus.
Figure 3:
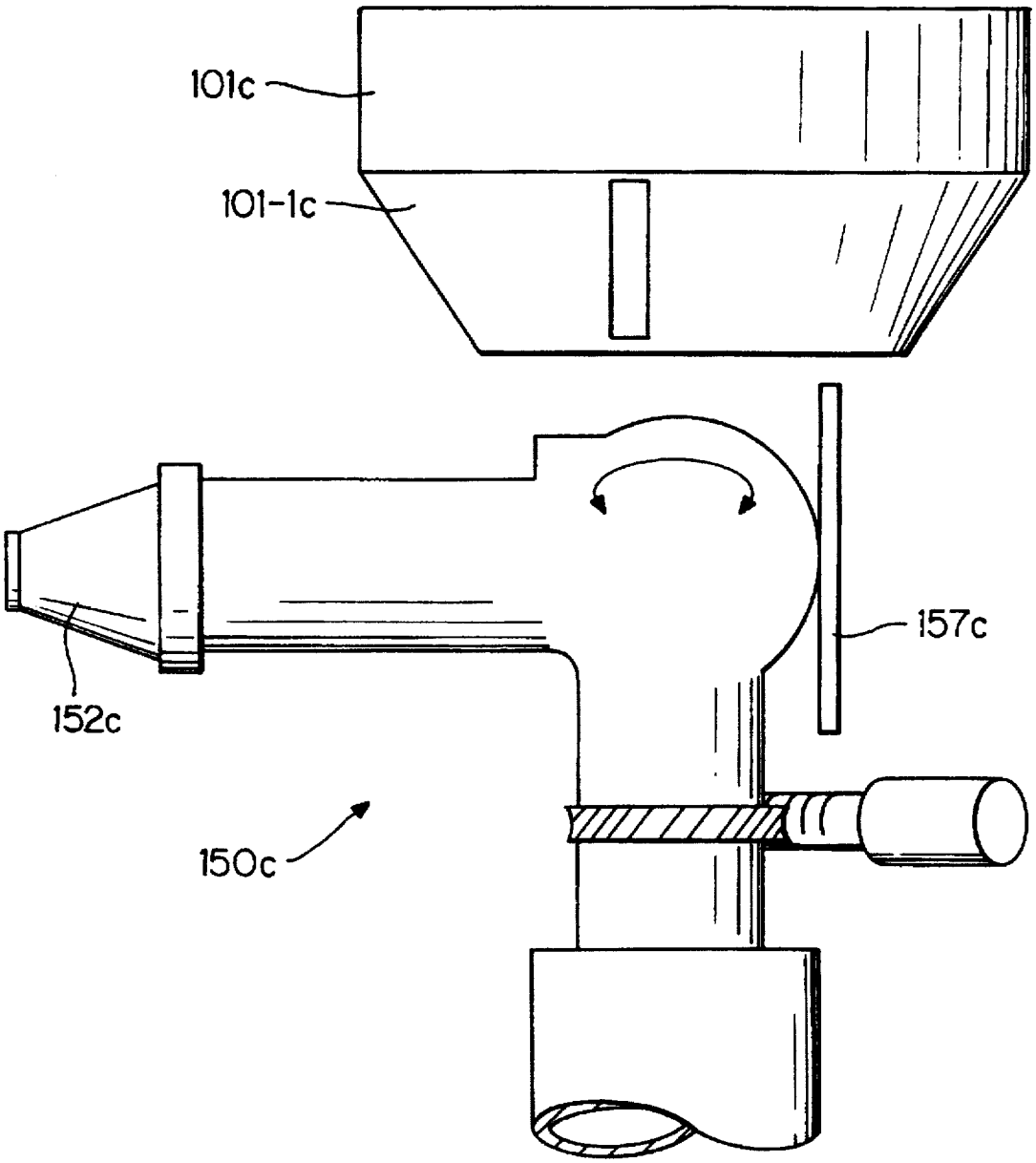
FIG. 3 is a side view showing a structural relationship between a fire detecting unit and a water-discharging nozzle in a third embodiment of the apparatus.

As shown in FIG. 1, the system includes a main unit case 100, a control board 201, a central operation unit 202 installed in such as a building manager's office, and a local operation unit 203 installed in the vicinity of the main unit case 100. The main unit case 100, as shown in detail in FIG. 2, includes a 2-dimensional scan type fire detecting unit 101 and a water-discharging unit 150, which are coaxially arranged in the vertical direction. The fire-detecting unit 101*c* and water-discharging unit 150*c* may independently swing in the horizontal direction, as shown in FIG. 3.

Figure 4:
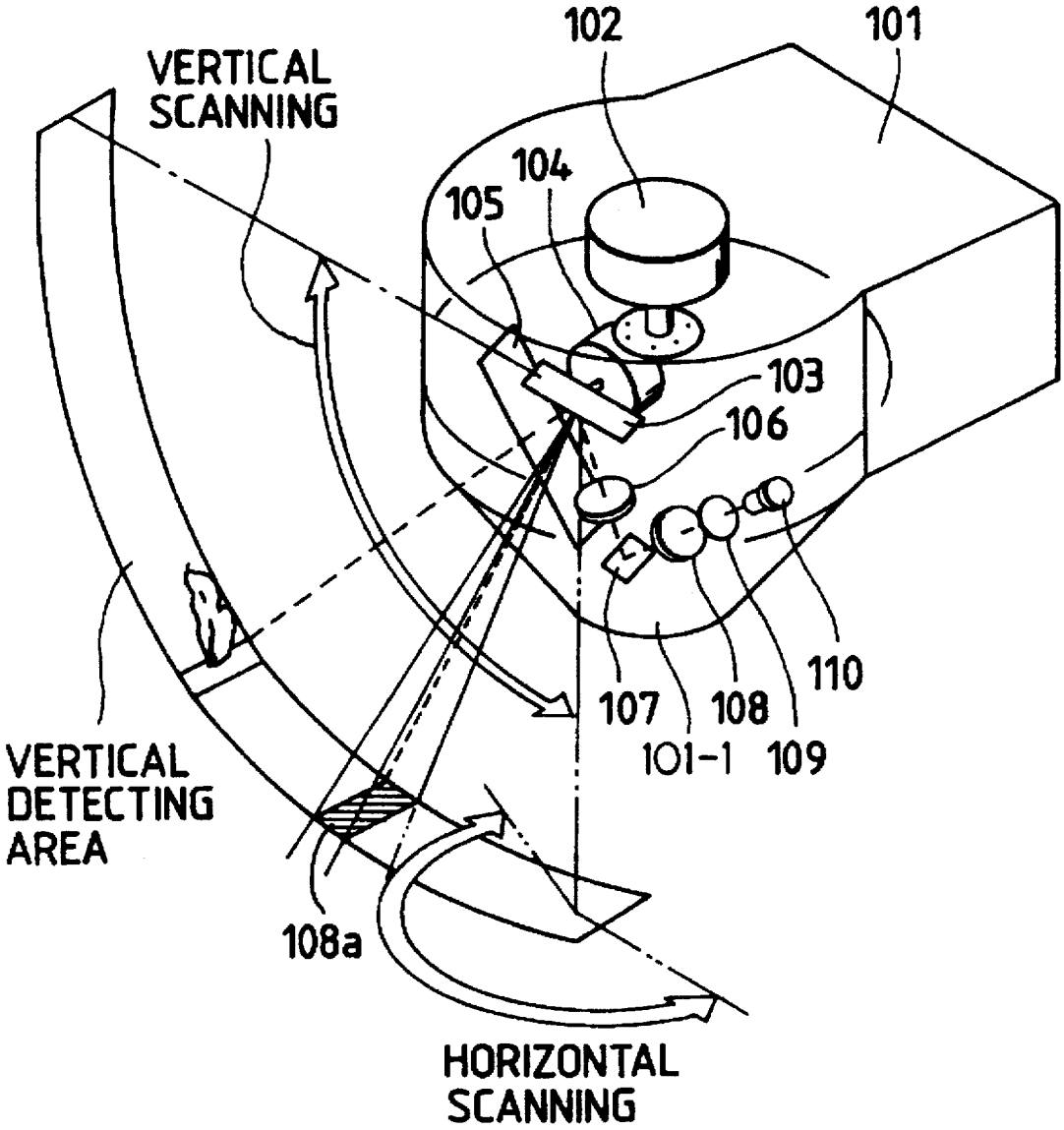
FIG. 4 is a view showing the construction of a scan type fire detecting unit.

The fire detecting unit 101 detects heat waves (infrared rays) emitted from flames. The fire-detecting unit 101 is provided with a swinging section to be described later. The swinging section is slightly protruded frontward from the front wall 100*a* of the main unit case 100. The swinging section is capable of horizontally scanning an area within about 190°. As shown in FIG. 4, a conical swing section 101-1 located on the lower side of the fire detecting unit 101 is horizontally and stepwise swung within the range of 190°, for example, in a reciprocal manner with respect to the main unit case 100 by a horizontal scan motor 102 as a pulse motor. A rotary mirror 103, both sides of which are formed of mirror, rotates itself at a speed, and simultaneously, the rotary mirror 103 vertically and upwardly moves at an equiangular speed so as to scan in a range from a position just under the fire-detecting unit 101 to the end of monitoring area of the fire-detecting unit 101. For driving the rotary mirror 103, a vertical scan motor 104 as a DC motor is used.

Infrared rays emitted from a monitoring area are controlled within a range defined by a window 105, viz., a range of 90° defined by a line extending downward therefrom to the plane horizontally and radially extending therefrom. After passing the window 105, the infrared rays are reflected by the rotary mirror 103, imaged by an objective lens 106, and reflected by a reflection mirror 107. An instantaneous visual field 108*a* is determined by a slit 108. The infrared rays are converged by a condenser lens 109 onto the infrared rays receiving surface of an infrared-rays sensor 110. The instantaneous visual field 108*a* means a monitor field on the presumption that the rotary mirror 103 is at a standstill.

Returning to FIG. 2, a disc 111 is fixed under the swing section 101-1 located on the lower side of the fire detecting unit 101. In this case, the disc 111 is arranged coaxially with the swing section 101-1, and horizontally rotatable together therewith. The disc 111 has an opening 112 which is arranged in the same direction as the opening window 105 (the horizontal direction of the rotary mirror 103 when it vertically scans). Accordingly, the opening 112 is always directed in the horizontal direction of the rotary mirror 103. The water-discharging unit 150 is formed with a vertical pipe 151*a* and an L-shaped pipe 151*b*. The vertical pipe 151*a* is vertically fixed to the main unit case 100 so that the opening end thereof is directed upward. The L-shaped pipe 151*b* being L-shaped when viewed from the side thereof is provided with a water discharging nozzle 152 fixedly attached to the front end thereof. The L-shaped pipe 151*b* is rotatable with respect to the opening end of the vertical pipe 151*a*. The L-shaped pipe 151*b* has a vertical portion the end of which is connected to the vertical pipe 151*a* and a horizontal portion the end of which is connected to the water discharging nozzle 152. As shown in FIG. 1, the vertical pipe 151*a* connects with a main water supply pipe 10 through an electrically driven valve 204. Incidentally, the main water supply pipe 10 may be connected to a sprinkler pipe of a sprinkler fire extinguishing facility which is separately provided.

A worm 153 is fixedly put on the outer surface of the vertical portion of the L-shaped pipe 151*b*. The worm 153 is in mesh with a worm wheel 155 mounted on the shaft of a nozzle drive motor 154. The nozzle drive motor 154 is fixed to the main unit case 100. When the nozzle drive motor 154 is turned, the L-shaped pipe 151*b* and the water discharging nozzle 152 at the front end of the L-shaped pipe 151*b* are swung horizontally.

A photointerrupter 156 is attached to the upper side of the L-shaped pipe 151*b* at a position on a line directed in the same direction as of the water-discharging nozzle 152. The photointerrupter 156 includes a light emitting element and a photosensing element. The peripheral part of the disc 111 of the swing section 101-1 on the lower side of the fire-detecting unit 101 passes through a gap between the light emitting element and the photosensing element. A detecting signal is produced when the opening 112 of the disc 111 is coincident in position with the photointerrupter 156, viz., when the direction of the water-discharging nozzle 152 is coincident with the horizontal direction of the rotary mirror 103 when it scans in the vertical direction. The photointerrupter 156 may be substituted by a limit switch, for example.

Figure 6:
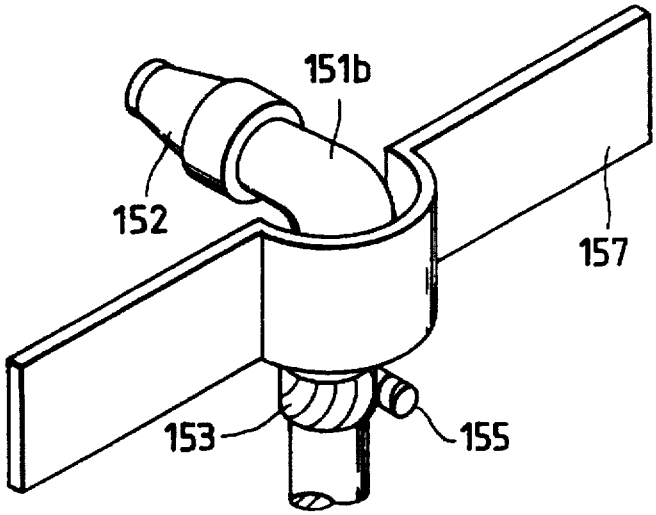
FIG. 6 is a perspective view of FIG. 5.
Figure 7:
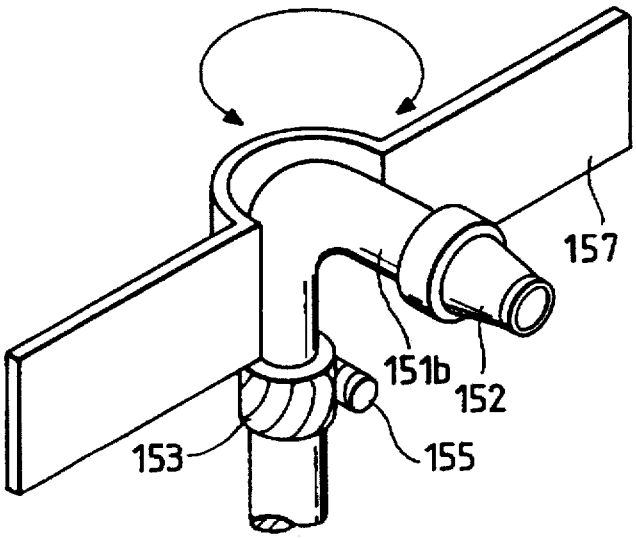
FIG. 7 is a perspective view showing the structural relationship between the water-discharging nozzle and the cover when a fire occurs.

A cover 157 is mounted on a side of the L-shaped pipe 151*b*, the side being opposite to the other side where the water discharging nozzle 152 is provided. As illustrated in detail in FIG. 5, when the water-discharging nozzle 152 is directed opposite to the front side and placed in the main unit case 100, the cover 157 is substantially flush with the front wall 100-1 of the main unit case 100. As illustrated in detail in FIGS. 6 and 7, when the water discharging nozzle 152 and the L-shaped pipe 151*b* are horizontally turned, the cover 157 fixed to the L-shaped pipe 151*b* is also turned. In a water-discharging state in that the water-discharging nozzle 152 and the L-shaped pipe 151*b* are projected from the front wall 100-1, a part of the cover 157 is received in the main unit case 100.

Figure 8:
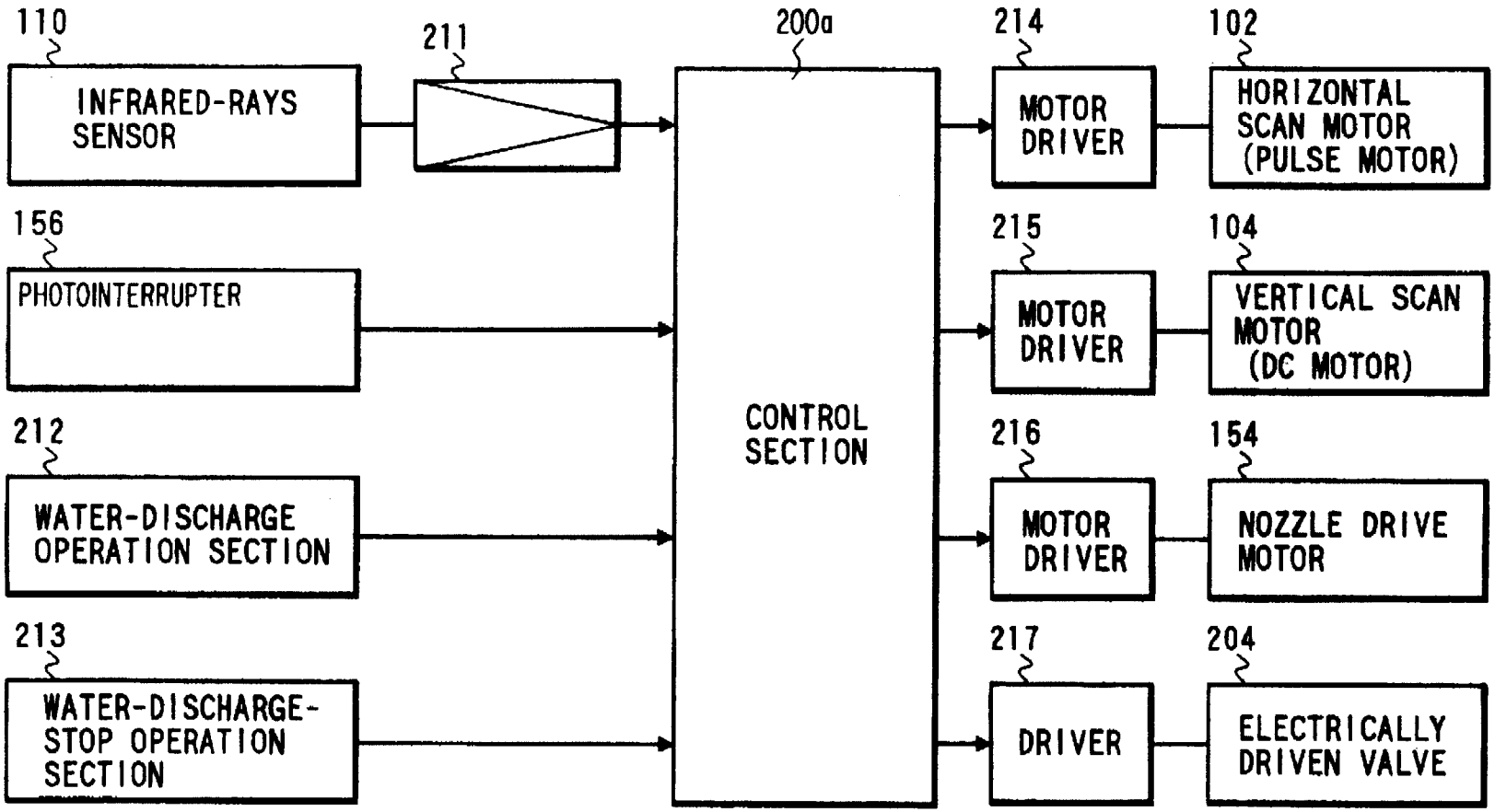
FIG. 8 is a block diagram showing a control system for the fire detecting/extinguishing apparatus in the first embodiment.

A control system of the fire detecting/extinguishing apparatus thus mechanically constructed will be described with reference to FIG. 8. A control section 200*a* receives an amplified signal outputted from an amplifier 211 where a sensing voltage from the infrared-rays sensor 110 is amplified, a detecting signal from the photointerrupter 156, a water-discharging signal from the photointerrupter 156, and a water-discharge-stop signal from a water-discharge-stop operation section 213. A water-discharge operation section 212 and the water-discharge-stop operation section 213 are both contained in the central operation unit 202, and also in the local operation unit 203 shown in FIG. 1. In response to these signals, the control section 200*a* controls the horizontal scan motor 102, vertical scan motor 104, nozzle drive motor 154, and the electrically driven valve 204, through the drivers 214 to 217 associated therewith, respectively. The details of the control by the control section 200*a* will be described later with reference to FIG. 11.

Figure 11:
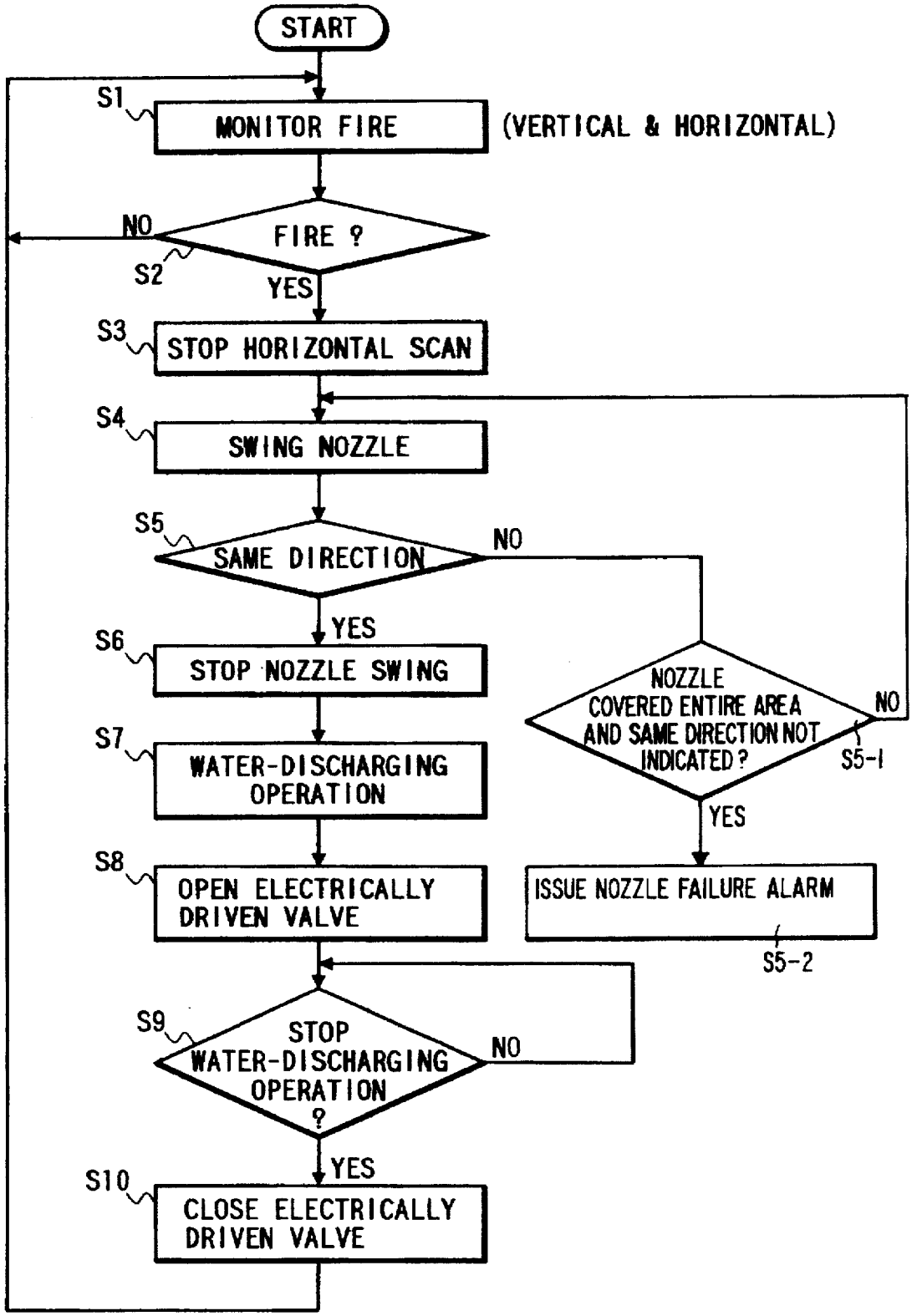
FIG. 11 is a flowchart showing the operation of the fire detecting/extinguishing apparatus in the first embodiment.

The operation of the above-mentioned embodiment will be described with reference to a flowchart shown in FIG. 11. In a loop of steps S1→S2→S1, the horizontal scan motor 102 is rotated stepwise and reciprocatively so that the swing section 101-1 is horizontally swung. The vertical scan motor 104 is driven to turn the rotary mirror 103 for the vertical scan at an equiangular speed. Through the operation, the detecting signal of the infrared-rays sensor 110 is monitored to thereby judge as to whether or not a fire occurs. If the control section 200*a* determines, in the step S2, that a fire occurs, it advances to a step S3, and at this time, it stops the horizontal scan motor 102.

Figure 5:
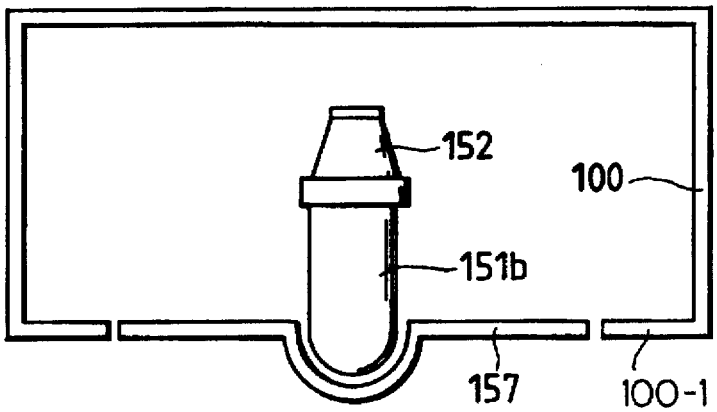
FIG. 5 is a perspective plan view showing a structural relationship between the water-discharging nozzle and a cover in a normal situation.

In a step S4, the control section 200*a* issues a signal to cause the nozzle drive motor 154 to turn so that the water-discharging nozzle 152 starts to swing from an initial state as shown in FIG. 5. Then, the water-discharging nozzle 152, which has been concealed by the cover 157, appears in the front of the main unit case 100.

In a step S5, the control section 200*a* determines whether or not the water-discharging nozzle 152 is directed in the same direction as of the opening window 105 of the fire detecting unit 101, that is, the fire direction, on the basis of a detecting signal from the photointerrupter 156. If the directions of these components are different from each other, the control section 200*a* swings the water discharging nozzle 152 until those components are directed in the same direction (step S6). If the water-discharging nozzle 152 has been swung over the entire monitoring area and the photointerrupter 156 has not issued the detecting signal (step S5-1), then a nozzle failure alarm is generated (step S5-2). Therefore, since the fire-detecting unit 101 is stopped in a state where it is directed in the fire detecting direction, the water-discharging nozzle 152 also stops to be directed in the fire detecting direction. Then, the water-discharge operation section 212 conducts the water-discharging operation so that the electrically driven valve 204 is opened to allow water to be discharged through the water-discharging nozzle 152 (step S7→step S8). When the water-discharge-stop operation section 213 stops the water-discharging operation, the electrically driven valve 204 is closed to stop the water-discharging. (step S9 to step S10).

In this state, the restoration operation is conducted at the central operation unit 202 or the local operation unit 203 so that the water-discharging nozzle 152 swings to return to the initial state, viz., the position shown in FIG. 5. The water-discharging nozzle 152 is housed in the main unit case 100 while being kept from sight by the cover 157. Incidentally, the water-discharging nozzle 152 may be operated manually.

When dust sticks to the detecting part of the photointerrupter 156 or the opening 112, sometimes no detecting signal is produced from the photointerrupter 156 even if the water-discharging nozzle 152 is swung over the entire fire monitoring range from a swing start timing to a swing end timing (step S5-1). In this case, it is swung again (step S4-step S5) or a nozzle failure alarm is generated (step S5-2) so that a fail-safe function is secured.

Further, a second embodiment of the fire detecting/extinguishing apparatus according to the present invention will be described as follows. The descriptions of the components and elements which are the same as those of the first embodiment are omitted here.

Figure 12:
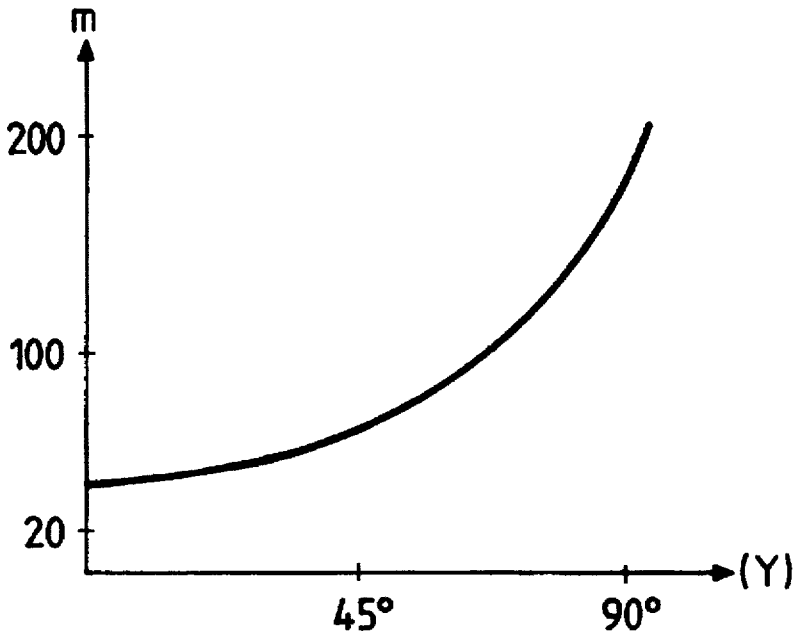
FIG. 12 is a graph showing a relationship between a vertical scan angle and a scan distance corresponding thereto.
Figure 13:
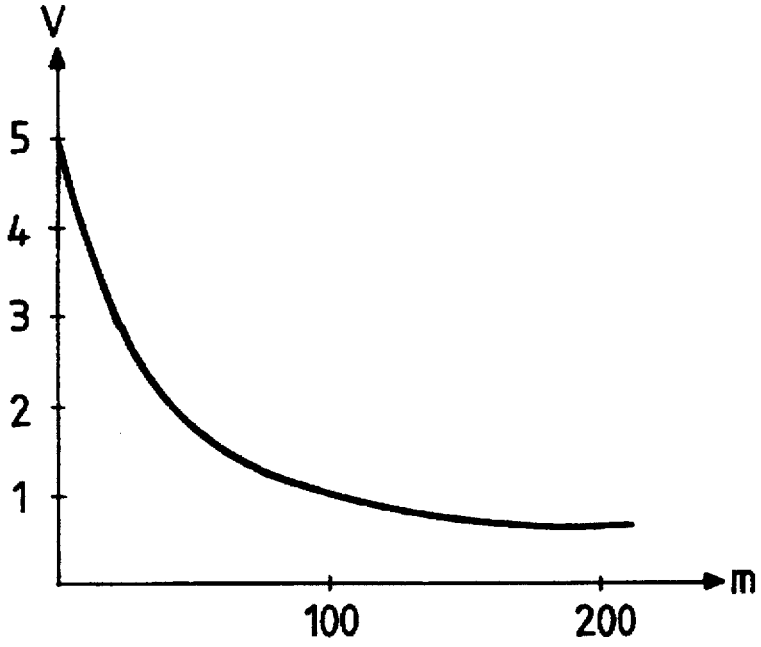
FIG. 13 is a graph showing a variation of a fire decision level with respect to the vertical scan distance.

In the second embodiment, the rotary mirror of the fire-detecting unit 101, both sides of which are formed of mirror, rotates itself at a uniform speed, and simultaneously, the rotary mirror vertically and upwardly moves at an equiangular speed so as to scan in a range from a position just under the fire-detecting unit 101 to the end of monitoring area of the fire-detecting unit 101. To convert the scan angle into the corresponding scan distance in the horizontal plane, data on the scan distance (m) for each vertical (Y) scan angle (relationship of the scan distance and the scan angle is shown in FIG. 12) is stored in advance in a memory of the control section **200*b*. In this case, the data is stored in the form of a table. The control section 200*b* converts the vertical scan into the corresponding scan distance every vertical scan while referring to the stored stable. A voltage V produced by the infrared rays sensor 110, when it senses flames, decreases as the distance of the flames increases from the sensor, as shown in FIG. 13. In consideration of this fact, a threshold voltage Vth which depends on distance (m) is previously stored in the memory of the control section 200*b***.

In addition, when the infrared-rays sensor 110 senses light due to a flame, the detecting voltage V in time sequence detected at a same point in the vertical direction fluctuates with time t at a frequency, generally 1 to 10 Hz. On the other hand, if the light is the sunlight or light by illumination, the detecting voltage V is invariable with time t, thereby having no fluctuation.

Figure 9:
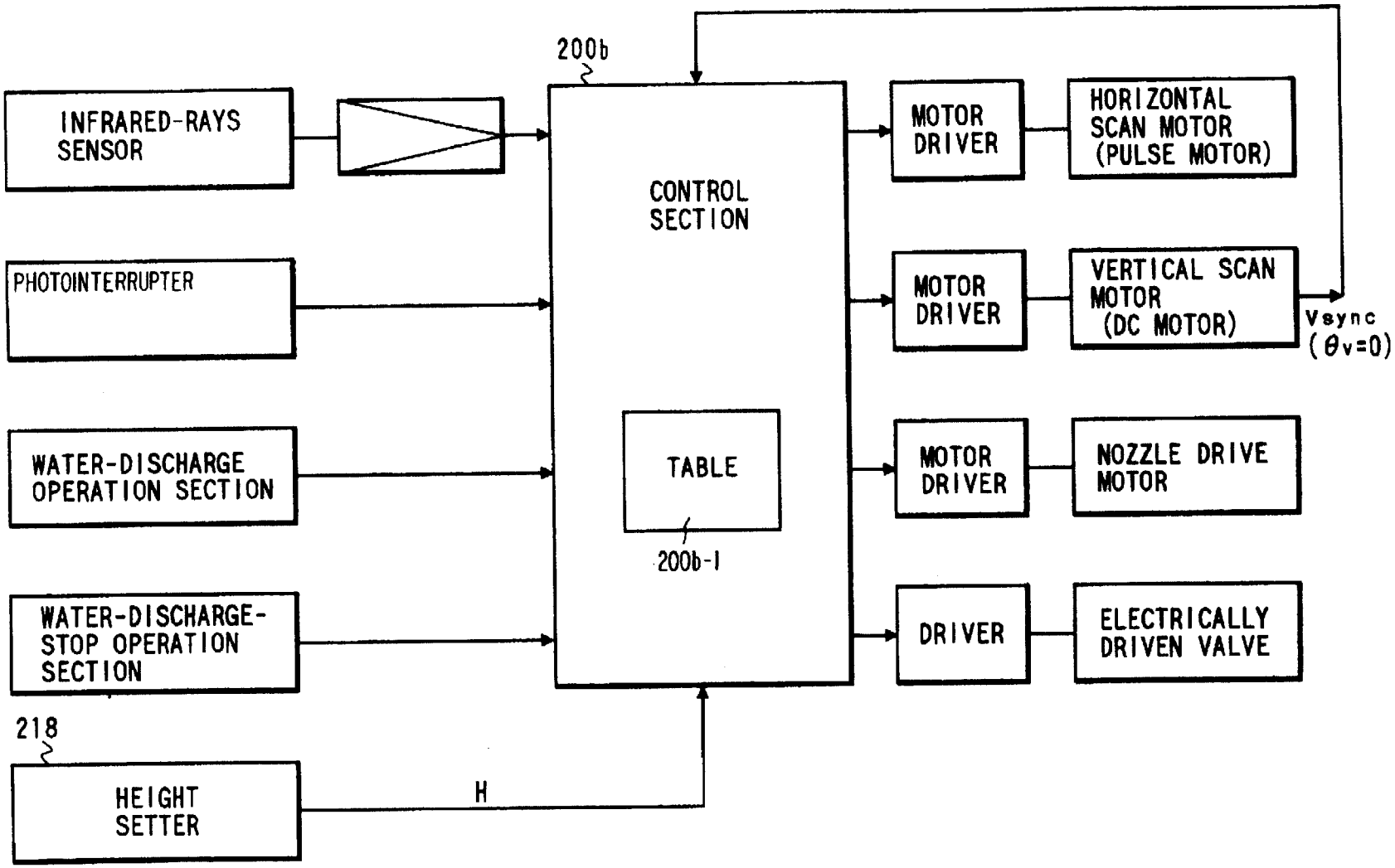
FIG. 9 is a block diagram showing a control system for the fire detecting/extinguishing apparatus in the second embodiment.
Figures 15, 16:
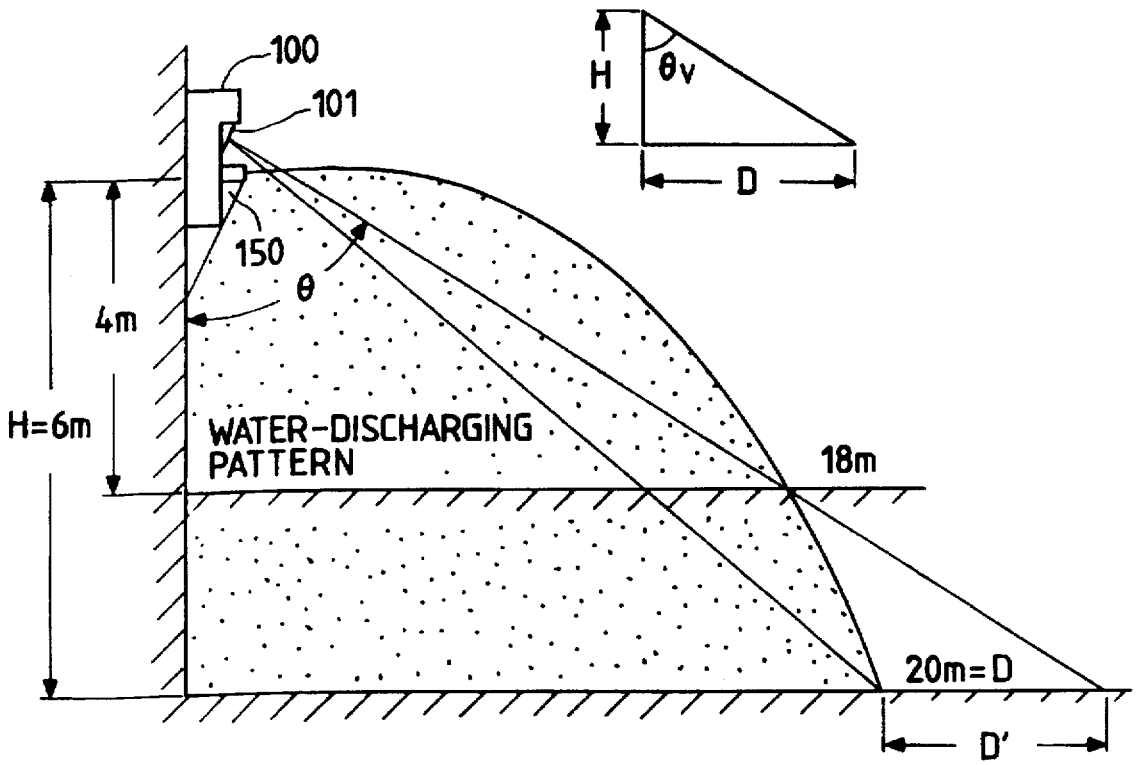
FIG. 15 is an explanatory diagram showing the relationship among the height of the fire detecting unit and the water-discharging unit from the floor level.
FIG. 16 is a table showing the relationship between the height of the fire detecting unit and the vertical scan angle.

In the second embodiment, as shown in FIG. 9, the control section **200*b* is provided with a memory table 200*b*-1. The table 200*b*-1 stores the correspondence of a height H and a vertical scan angle θv as shown in FIG. 16. The height H is a height where the main unit case 100 is installed. The vertical scan angle θv is the monitoring area in the vertical direction. As shown in FIGS. 4 and 9, when the rotary mirror is directed just below (θv=0), the vertical scan motor produces a vertical sync signal Vsync for transmission to the control section 200*b*. A height setter 218 including a dip switch is provided for setting the height of the fire detecting/extinguishing apparatus from the floor level when it is installed. An operator manually may set the height of the height H of the installed apparatus by operating the height setter 218. In response to the vertical sync signal Vsync, the control section 200*b* starts to detect a vertical scan angle, and collects data from the infrared-rays sensor in the range within the vertical angle up to 90°. The control section 200*b* judges a fire based on data from the infrared-rays sensor, in which the data is within the range of 0° to the vertical scan angle θv which is a vertical fire judgement area corresponding to the height H previously stored in the table 200*b*-1**. According to this method and structure, the water-discharging area can coincide with the fire judgement area.

Figure 14:
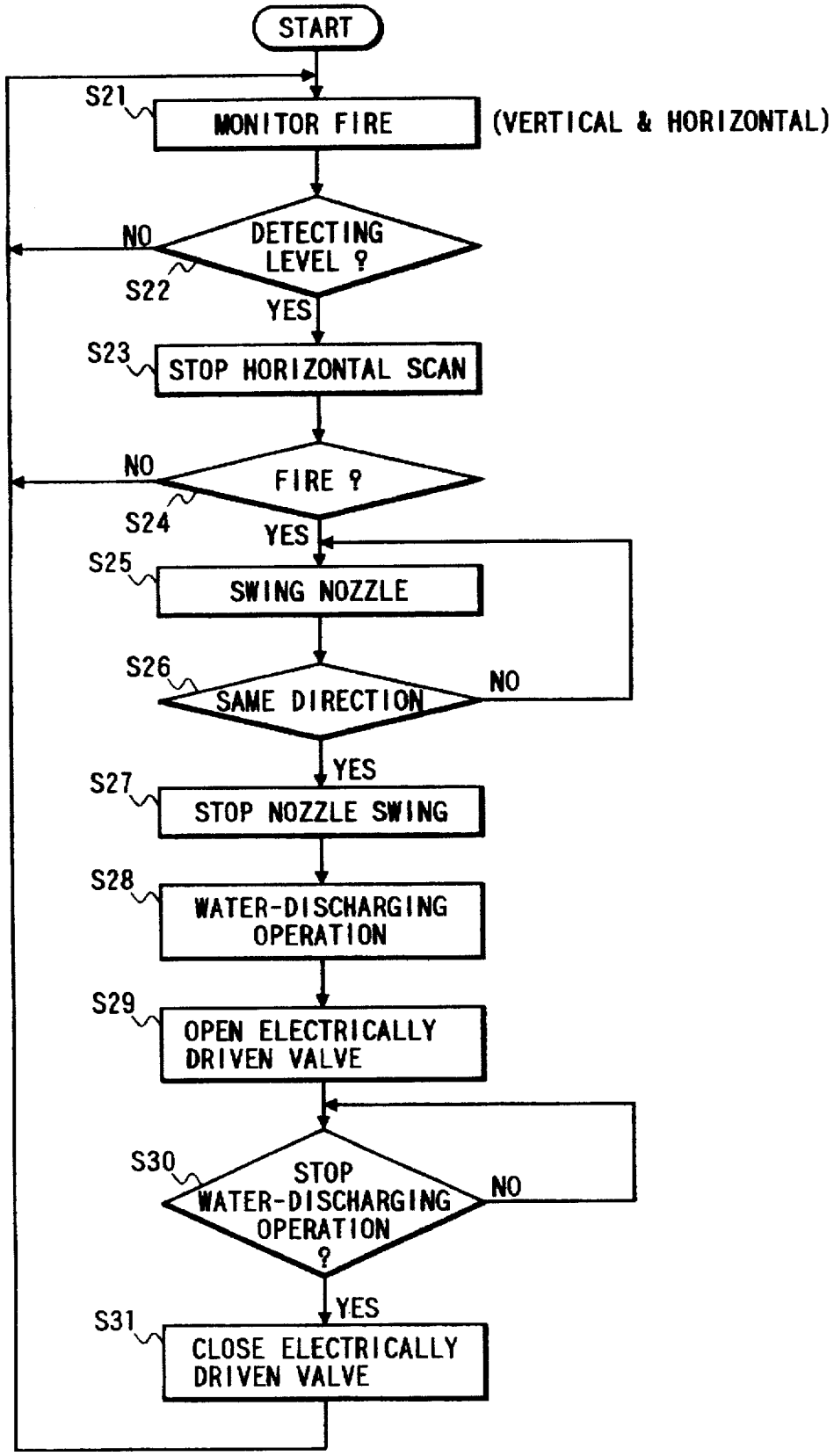
FIG. 14 is a flowchart showing the operation of the fire detecting/extinguishing apparatus in the second embodiment.

The operation of the control section **200*b* will be described with reference to a flowchart shown in FIG. 14. In a loop of steps S21→S22→S21, the horizontal scan motor is rotated stepwise and reciprocatively so that the swing section 101-1 is horizontally swung. The vertical scan motor is driven to turn the rotary mirror for the vertical scan at an equiangular speed. Through the operation, the control section 200*b*** collects data of the voltage V of the infrared-rays sensor in the range of the vertical angle from 0° to 90°.

After the scan up to 90°, the control section **200*b* proceeds to the next fire monitor mode, when the data collected within the range from 0° to θv (if the installing height is 6 m, θv=71°) corresponding to the installing height H stored in the table 200*b*-1 of the control section 200*b* is higher than the threshold value Vth corresponding to the distance as shown in FIG. 13. At the time of its detection, the control section 200*b*** stops only the horizontal scan motor and turns the vertical scan motor at such a speed as to sample the frequency of the fluctuation of a flame (step S23).

Since both sides of the rotary mirror are formed of mirror and the rotary mirror is turned by the vertical scan motor at the speed of 8 rotation/sec., the rotary mirror samples the flame in the vertical direction at the rate of 16 times/sec. Accordingly, it is possible to detect the flame 20 fluctuation at 8 Hz or lower based on the sampling theorem. Similarly, when the flame is sampled at 32 times/sec., it is possible to detect the flame fluctuation at 16 Hz or lower. Also, in this fire monitoring state, the flame is detected in the range up to the vertical scan angle θv corresponding to the installing height H.

When the fluctuation of the flame is detected as the result of analyzing the detecting signal, it is decided that a fire occurs. The control section advances from the step S24 to a step S25 and the subsequent steps. On the other hand, when the control section decides that the light emitting object is static light, such as the sunlight or light by illumination, the control section returns to the step S21. In this step, the control section starts the two-dimensional fire monitoring operation. In a step S25, the control section starts the swinging of the water-discharging nozzle 152 from its initial state as shown in FIG. 5. Then, the water discharging nozzle 152, which has been concealed by the cover 157, appears.

In the subsequent step S26, the control section **200*b* judges as to whether or not the water-discharging nozzle 152 is directed in the same direction as of the fire detecting unit 101 on the basis of a detecting signal from the photointerrupter. If the directions of these components are different from each other, the control section 200*b* swings the water-discharging nozzle 152 so that those components are directed in the same direction (step S27). The swing section 101-1 stops in a state that it assumes the fire detecting direction when viewed in the horizontal direction (step S23). Accordingly, the water-discharging nozzle 152 also stops while being directed in the fire detecting direction. Then, when the water-discharging operation is conducted in the water-discharge operation section, the electrically driven valve is opened to allow water to be discharged through the water-discharging nozzle 152** (step S28→step S29). When the water-discharging is stopped by the water-discharge-stop operation section, the electrically driven valve is closed to stop the water-discharging (step S30 to step S31).

As described above, in the second embodiment of the present embodiment, decision as to whether or not a fire occurs is made on the basis of the data from the fire monitoring area defined by the water—discharging distance corresponding to the installing height H of the main unit case 100. Therefore, the water discharging area is coincident with the fire monitoring area.

Figure 10:
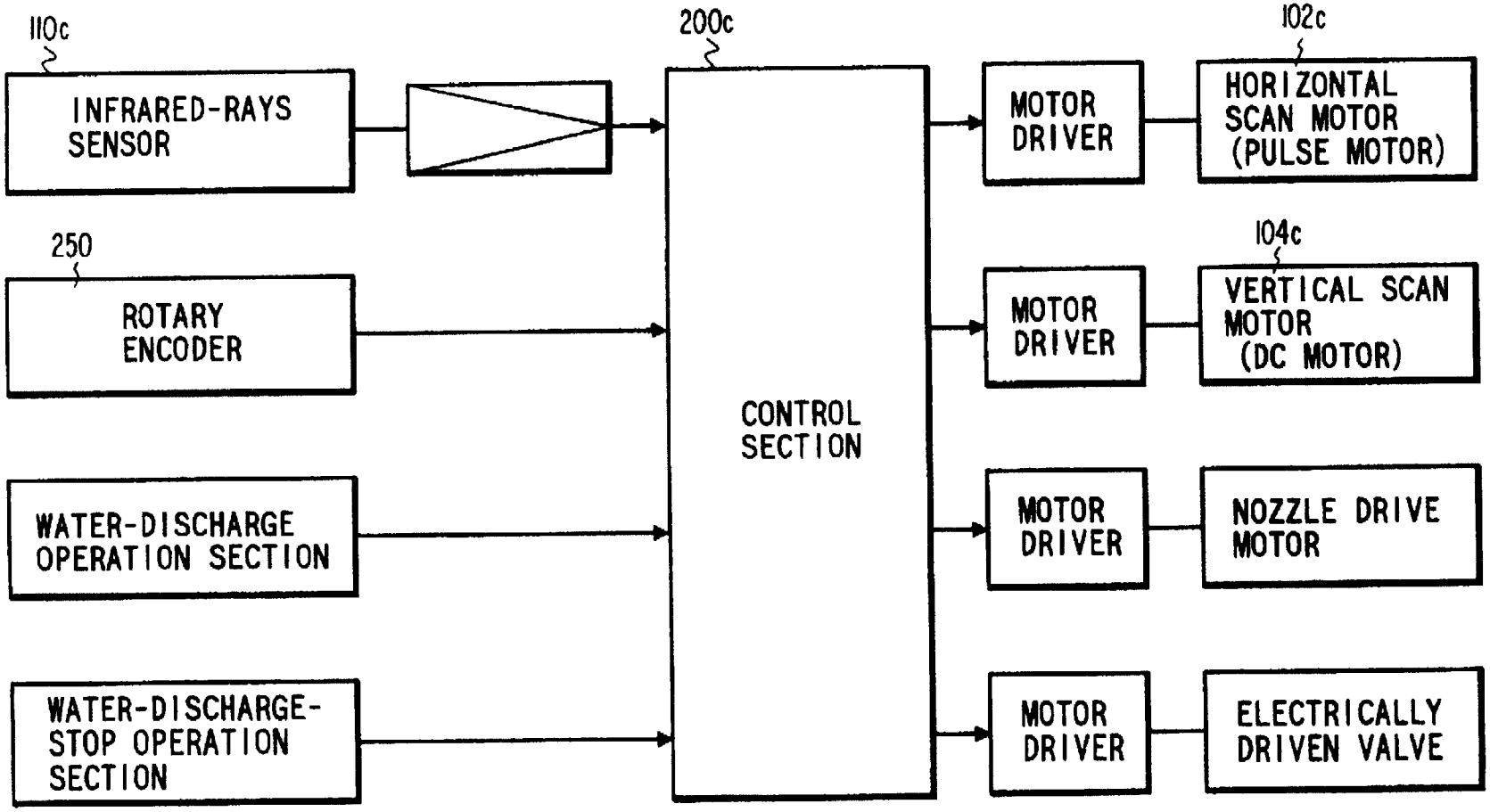
FIG. 10 is a block diagram showing a control system for the fire detecting/extinguishing apparatus in the third embodiment.

Further, referring to FIG. 10, a third embodiment of the fire detecting/extinguishing apparatus according to the present invention will be described as follows. The descriptions of the components and elements shown in FIG. 3 which are the same as those of the first embodiment shown in FIGS. 2 and 8 are omitted here. The vertical pipe, the worm, and worm wheel are the same as those of the first embodiment. The amplifier and the drivers are the same as those of the first embodiment. Incidentally, as shown in FIG. 3, the photointerrupter 156 and disc 111 are not necessary in this embodiment. It is preferable that the swing section 101-1*c* moves coaxially with the water discharging nozzle 152. In this embodiment, a rotary encoder 250 is provided which detects the turning angle of the water-discharging nozzle 152*c*, that is, the rotating angle of the L-shaped pipe. The rotary encoder 250 is connected to the control section 200*c*.

As described above, the control section 200*c* controls and drives the horizontal scan motor 102*c* as the pulse motor so that the swing section 101-1*c* is stepwise and reciprocatively swung, e.g., within the range of 190°. The control section 200*c* also controls and drives the vertical scan motor 104*c* so that the rotary mirror 103 shown in FIG. 4 is rotated at the constant speed. Thus, the control section 200*c* monitors the detecting signal from the infrared-rays sensor 110*c* so as to judge the occurrence of the fire. Incidentally, the control section 200*c* counts the number of pulses from the position of 0° so as to calculate the horizontal scan angle of the horizontal scan motor 102*c* based on angle information including the number of pulses and an angle by one step, and outputs the horizontal scan angle thus calculated.

If the control section 200*c* judges the occurrence of the fire according to the detecting signal from the infrared-rays sensor 110*c* during the scanning, the control section 200*c* calculates an angle for directing the water-discharging nozzle 152*c* toward the fire direction according to the angle information of the horizontal scan motor 102*c* at the time of the judgement. Thereafter, the control section 200*c* starts to drive the nozzle drive motor to start the swing of the water-discharging nozzle 152*c* from its initial state. Then, the water-discharging nozzle 152*c*, which has been concealed by the cover, appears in the front of the main unit case 100. The control section 200*c* monitors the rotating angle of the L-shaped pipe based on the detecting output of the rotary encoder 250, and when the turning angle of the water-discharging nozzle 152 achieves the calculated angle, the nozzle drive motor is stopped. Incidentally, if the fire-detecting unit 101*c* is rotated coaxially with the water-discharging unit 150*c*, the angle information of the horizontal scan motor 102*c* at the time of the judgement of the fire directly corresponds to the turning angle of the water-discharging nozzle 152*c*. Accordingly, in this case, it is not necessary to calculate the turning angle of the water-discharging nozzle 152*c*.

In a state where the nozzle drive motor is stopped, namely, the water-discharging nozzle 152*c* is directed toward the fire direction, when the water-discharging operation is conducted in the water-discharge operation section, the control section 200*c* controls to open the electrically drive valve to start the water-discharging. Further, the water-discharge-stop operation is conducted in the water-discharge-stop operation section, the electrically driven valve is closed, thereby stopping the water-discharging.

In this state, the restoration operation is conducted at the central operation unit or the local operation unit so that the water discharging nozzle 152*c* swing to return to the initial state, viz., the position shown in FIG. 5. The water-discharging nozzle 152*c* is housed in the main unit case 100 while being kept from sight by the cover 152*c*.

In this embodiment, even if water is discharged from the water-discharging nozzle 152, the fire-detecting unit 101*c* can monitor the occurrence of the fire. Consequently, the fire detecting/extinguishing apparatus according to the present invention can promptly detect fires at a plurality of positions.

In the above described embodiments, the fire detecting/extinguishing apparatus is used. However, the present invention is not limited to use such an apparatus. For example, in order to a wide monitoring area in detail, a CCD sensor can be used in which a plurality of CCDs capable of detecting the infrared rays are arranged in linear.

In the above described embodiments, the control section 200*a* to 200*c* may be provided in the control panel 201 or main unit case 100. Further, a part of the control section 200*a* to 200*c* may be provided in the control panel 201, and other part may be provided in the main unit case 100. For example, the fire detecting unit in the main unit case controls the horizontal and vertical scan, and the whole of controls and judgements accompanying with the fire detecting such as a fire judgement, and the remaining controls are conducted in the control panel. Further, it may be considered that the control section is provided in the main unit case 100.

Next, embodiments as to the water discharging nozzle used in the above described fire detecting/extinguishing apparatus will be described referring to the accompanying drawings.

Figure 17:
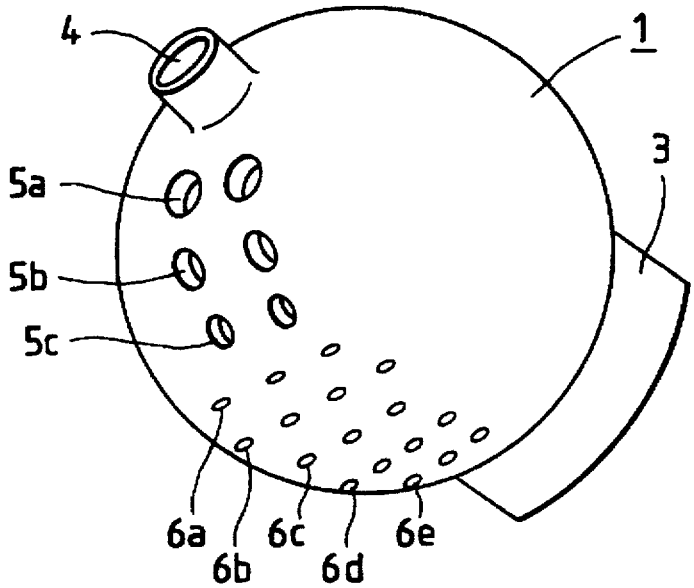
FIG. 17 is a perspective view showing an embodiment of a short-range water discharging nozzle according to the present invention, the view being seen from the front and underside of the nozzle.

FIG. 17 is a perspective view showing an embodiment of a short-range water discharging nozzle according to the present invention, the view being seen from the front and underside of the nozzle. The short-range water-discharging nozzle is connected to the top end of the water-discharging unit.

In FIG. 17, a short-range water discharging nozzle of the present invention includes a ball-shaped nozzle body 1. A water supply port 3 with a threaded hole for connecting a water supply pipe is formed in the rear part of the nozzle body 1. The inside of the nozzle body 1 is hollow.

A long-range water-discharging nozzle tube 4, medium-range water-discharging nozzle holes 5*a*, 5*b*, and 5*c*, and very short-range water-discharging nozzle holes 6*a*, 6*b*, 6*c*, 6*d*, and 6*e* are formed in the ball-shaped nozzle body 1 while being directed in the water-sprinkling directions. The medium-range water discharging nozzle holes 5*a*, 5*b*, and 5*c* are arrayed in two columns and three lines. The very short-range water-discharging nozzle holes 6a, 6b, 6c, 6d, and 6e are arranged such that horizontal linear arrays consisting of three and four nozzle holes are alternately repeated. The number of the nozzle holes in the horizontal direction may be the same.

Figure 18:
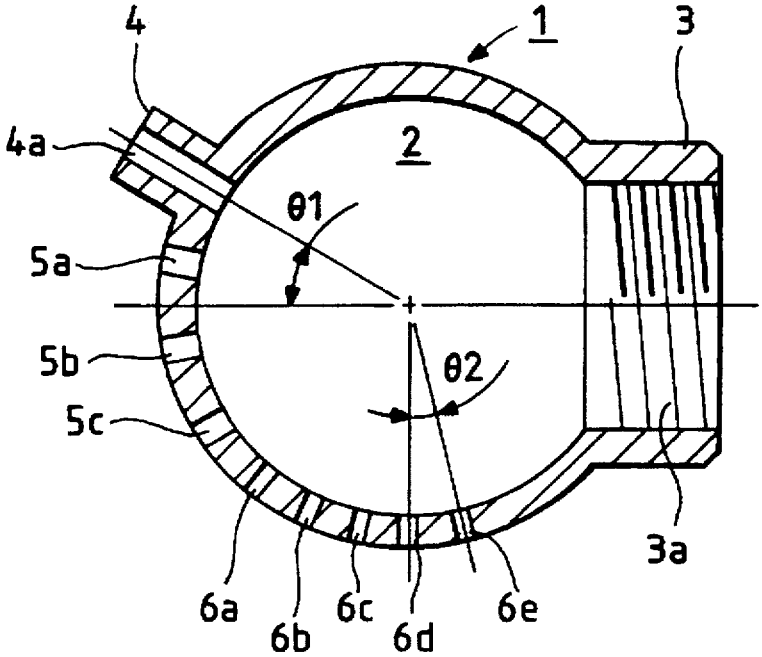
FIG. 18 is a cross-sectional view taken on line 18—18 in FIG. 20.
Figure 20:
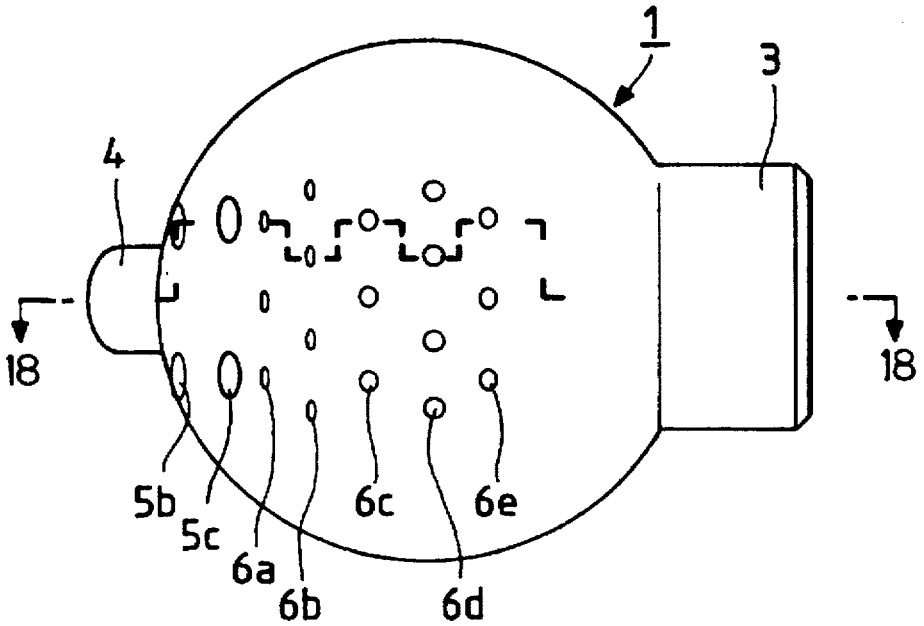
FIG. 20 is a bottom view showing the short-range water discharging nozzle of the present invention.

FIG. 18 is a cross-sectional view taken on line 18—18 in FIG. 20. A hollow portion 2 is formed inside of the nozzle body 1. The water supply portion 3 with a threaded hole 3a is mounted at the end of the hollow portion 2. On the front side which is the water-sprinkling direction of the nozzle body 1, a long-range nozzle hole 4a is upward slanted at an angle θ1 with respect to a horizontal plane. The long-range nozzle hole 4a is defined by the long-range water discharging nozzle tube 4. The angle θ1 is set to be equal to or less than 45° so as to obtain the maximum distance of the water discharging.

The array of the medium-range water discharging nozzle holes 5a, 5b, and 5c is located under the long-range nozzle hole 4a. The hole diameter of each of the medium-range water-discharging nozzle holes 5a, 5b, and 5c is smaller than that of the long-range nozzle hole 4a. Some of the medium-range water-discharging nozzle holes 5a, 5b, and 5c are slanted with respect to the horizontal plane at an angle smaller than the discharging angle θ1 of the long-range water-discharging nozzle tube 4. The remaining medium-range water-discharging nozzle holes 5a, 5b, and 5c are slanted downward.

Figure 19:
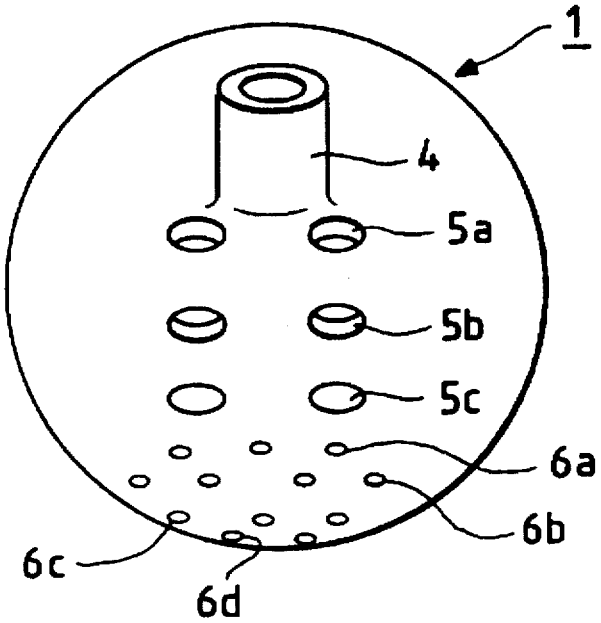
FIG. 19 is a front view showing the short-range water discharging nozzle of the present invention.

The array of the very short-range water-discharging nozzle holes 6a, 6b, 6c, 6d, and 6e is located under the array of the medium-range water-discharging nozzle holes 5a, 5b, and 5c. The hole diameter of each of the very short-range water-discharging nozzle holes is smaller than that of each of the medium-range water discharging nozzle holes, but the number of the very short-range water-discharging nozzle holes is larger than that of the medium-range water-discharging nozzle holes. In the present embodiment, as seen from the front view of FIG. 19 and the bottom view of FIG. 20, the very short-range water-discharging nozzle holes are arranged such that a horizontal linear array consisting of three and four nozzle holes is alternately repeated.

Of those very short-range water-discharging nozzle holes 6a, 6b, 6c, 6d, and 6e formed in the nozzle body 1, the very short-range water-discharging nozzle holes 6a to 6d are directed forward with respect to the vertical line extended downward from the center of the nozzle body 1, and directed downward along the vertical line. The very short-range water-discharging nozzle hole 6e is directed rearward of the nozzle body and slanted downward at an angle θ2. Meanwhile, the water-discharging nozzle structure of the invention is mounted on the wall of a building in a state that it is somewhat protruded forward from the wall. An area ranging from the dischared water discharging nozzle structure to the wall located rearward of the installed nozzle structure must be contained in the effective water-sprinkling area. It is for this reason that the very short-range water discharging nozzle hole 6e is directed rearward and slanted downward at the angle θ2. The angle θ2 is set to be equal to or less than 45° due to the structure of the nozzle.

Figure 21:
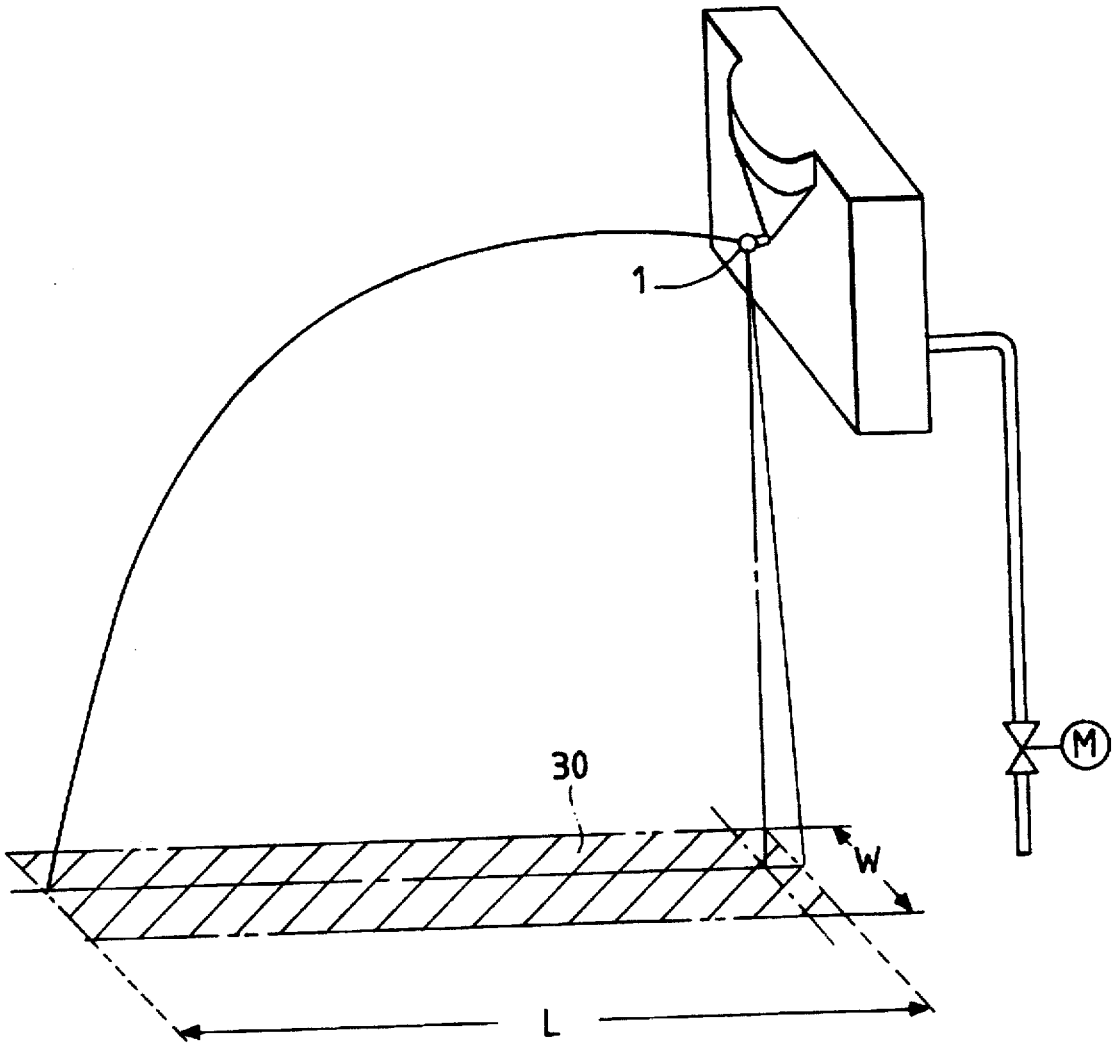
FIG. 21 is explanatory diagram showing an effective water-sprinkling area by the short-range water discharging nozzle of the present invention.
Figure 22:
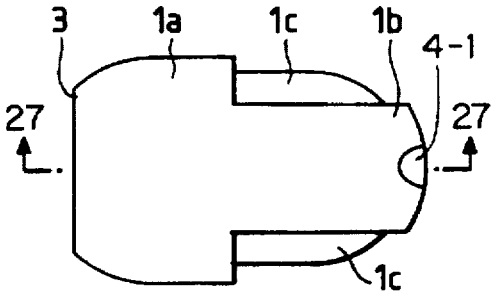
FIG. 22 is a plan view showing another embodiment of the short-range water discharging nozzle according to the present invention.
Figure 23:
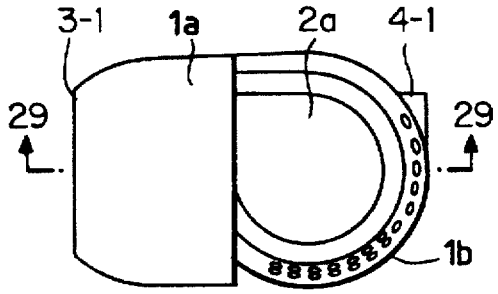
FIG. 23 is a side view of FIG. 22.
Figure 24:
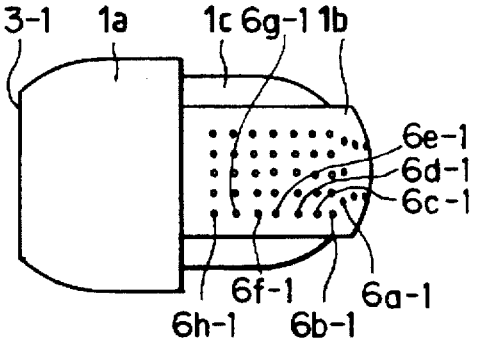
FIG. 24 is a bottom view of FIG. 22.

FIG. 21 is a diagram showing an installed short-range water-discharging nozzle and an effective water-sprinkling area according to the nozzle structure of the present invention. The nozzle body 1 is provided at the top end of the water-discharging unit of the main unit case. The nozzle body 1 is communicated with the main water supply pipe through the electrically driven valve. When the water-discharging operation is conducted at the 10 water-discharge operation section, the electrically driven valve is driven and opened to supply pressurized extinguishing water to the nozzle body 1.

The pressure applied to the water supplied to the water discharging nozzle unit, through the main water supply pipe, is low, for example, 2.5 $Kg/cm^2$. The fire-detecting unit is installed in the main unit case to detect a fire source in a fire monitoring area so as to automatically conduct the fire extinguishing operation. Such an operation is the same as that of above described embodiments of the fire detecting/extinguishing apparatus.

The fire detecting/extinguishing apparatus having the ball-shaped nozzle body 1 of the present invention is installed in a small space of a building in which the floor area is several hundreds $m^2$ and the ceiling is high where a fire protection is difficult for the conventional fire detector/sprinkler equipment. The effective water-sprinkling area 30 required for such a space is as follows: the water-sprinkling distance L is approximately 18 m, and the width W is approximately 4 m. As a result of tests, even if water is supplied to the nozzle body 1 at low pressure of 2.5 $Kg/cm^2$, the nozzle body 1 having the structure shown in FIGS. 17 to 20 can sprinkle a satifactory amount of water over the effective water-sprinkling area 30.

The function of the nozzle body 1 for securing the effective water-sprinkling area 30 will be described with reference to FIG. 18. Of the effective water-sprinkling area 30, the long range zone from 14 m to 18 m from the main unit case 100 is covered by the long-range water-discharging nozzle tube 4 which is upward slanted at the angle θ1 with respect to the horizontal plane. That is, water discharged from the long-range nozzle hole 4a of the long-range water discharging nozzle tube 4 is discharged over the long range zone. In this case, the discharging angle θ1 of the long-range nozzle hole 4a and the long-range water discharging nozzle tube 4 may be approximately 15°, θ1=15°.

The medium range zone from 5 m to 14 m is covered by the medium-range water-discharging nozzle holes 5a, 5b, and 5c, located under the long-range water-discharging nozzle tube 4. The short range zone from 0 to 5 m is covered by the very short-range water-discharging nozzle holes 6a, 6b, 6c and 6d. The rearward zone, ranging from the installed nozzle body 1 to the wall located rearward of the installed nozzle structure, is also covered by the very short-range water discharging nozzle hole 6e.

Thus, the nozzle structure of the present invention can secure the square, effective water-sprinkling area 30 of 18 m long (water discharging distance L) and 4 m wide (width W) as shown in FIG. 21 by using the long-range, the medium-range, and the very short-range water-discharging nozzle holes of which the arrays, the number of nozzle holes, and hole diameters are properly selected.

Another embodiment of a short-range water-discharging nozzle according to the present invention will be described as follows.

FIGS. 22 to 26 are views showing another embodiment of the short-range water discharging nozzle according to the present invention, which are a plan view, a side view, a bottom view, a front view, and a rear view of the short-range water-discharging nozzle structure, respectively.

In FIGS. 22 to 26, a ball-shaped portion 1b is formed at the front end of a tubular nozzle body 1a with a water supply port 3-1. A hollow portion is formed inside of the ball-shaped portion 1b. Both sides 1c of the ball-shaped portion 1b are stepped down from the remaining part thereof since no nozzle holes are formed. As seen from the front view of FIG. 25, long-range water discharging nozzle holes 4*a*-1 and 4*b*, medium-range water discharging nozzle holes 5*a*-1 to 5*d*-1, and very short-range water discharging nozzle holes 6*a*-1 to 6*h*-1 (referring to FIG. 24) are arrayed from top to bottom.

Figure 25:
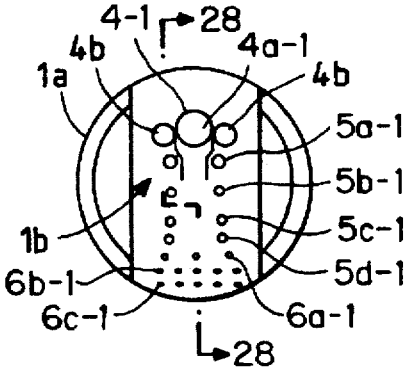
FIG. 25 is a front view of FIG. 22.
Figure 26:
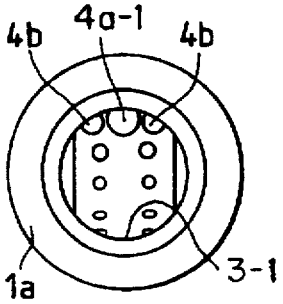
FIG. 26 is a rear view of FIG. 22.

As shown in FIG. 25, the long-range nozzle hole 4*a*-1 located in a center is formed passing through a long-range water discharging nozzle tube 4-1 projected from the ball-shaped portion 1*b*. A pair of the long-range nozzle holes 4*b* are located on both sides of the long-range nozzle hole 4*a*-1. The diameter of each of the long-range nozzle holes 4*b* is slightly smaller than that of the long-range nozzle hole 4*a*-1. Provision of the three long-range nozzle holes ensures a distal water sprinkling area. Particularly, the two long-range nozzle holes 4*b* ensure the wide distal water-sprinkling area.

Medium-range water discharging nozzle holes 5*a*-1 to 5*d*-1, located under the pair of the long-range nozzle holes 4*b*, are longitudinally arranged into two linear arrays respectively extending downward from the long-range nozzle holes 4*b*. The distance between the two linear arrays of the medium-range water discharging nozzle holes 5*a*-1 to 5*d*-1 is gradually increased from top to bottom, but the diameters of the medium-range water discharging nozzle holes are decreased in the same direction.

The very short-range water discharging nozzle holes 6*a* to 6*h* are arranged into seven lateral linear arrays; a first linear array consisting of three nozzle holes, and the remaining linear arrays each consisting of five nozzles holes. These first to seventh linear arrays 6*a*-1 to 6*h*-1 of the nozzle holes range from the bottom of the ball-shaped portion 1*b* to the rear side thereof.

Figure 27:
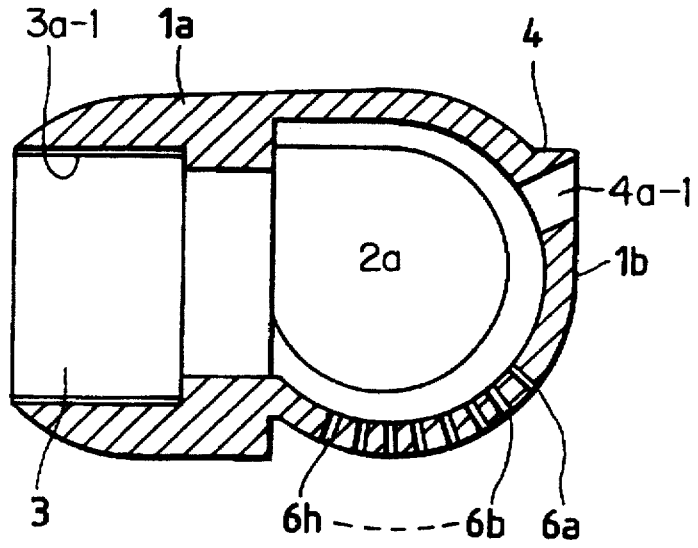
FIG. 27 is a cross sectional view taken on line 27—27 in FIG. 22.
Figure 28:
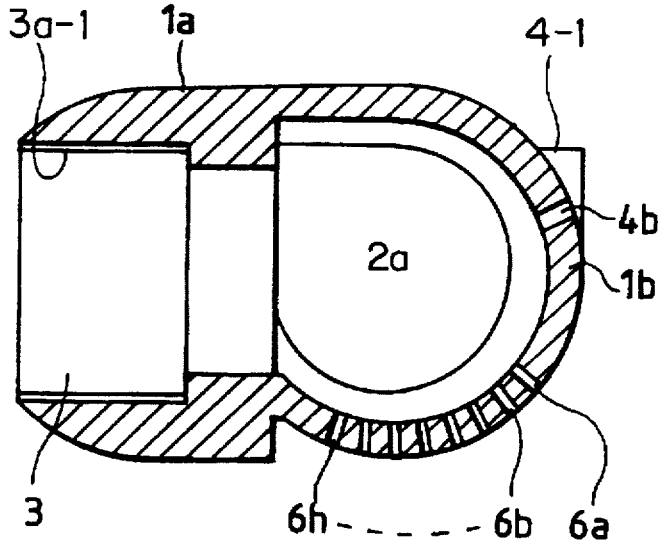
FIG. 28 is a cross sectional view taken on line 28—28 in FIG. 25.
Figure 29:
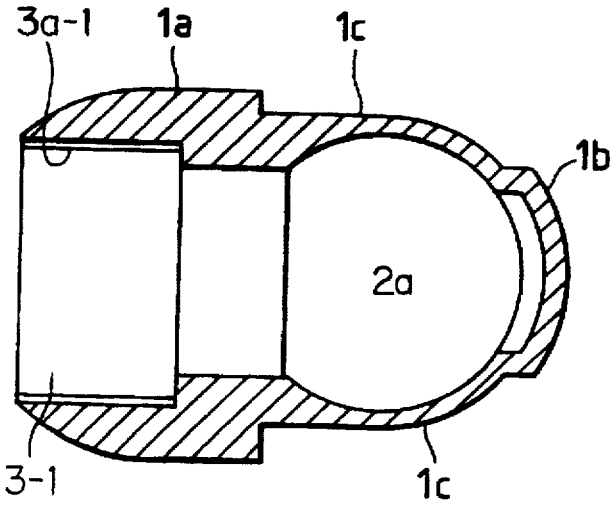
FIG. 29 is a cross sectional view taken on line 29—29 in FIG. 23.
Figure 30:
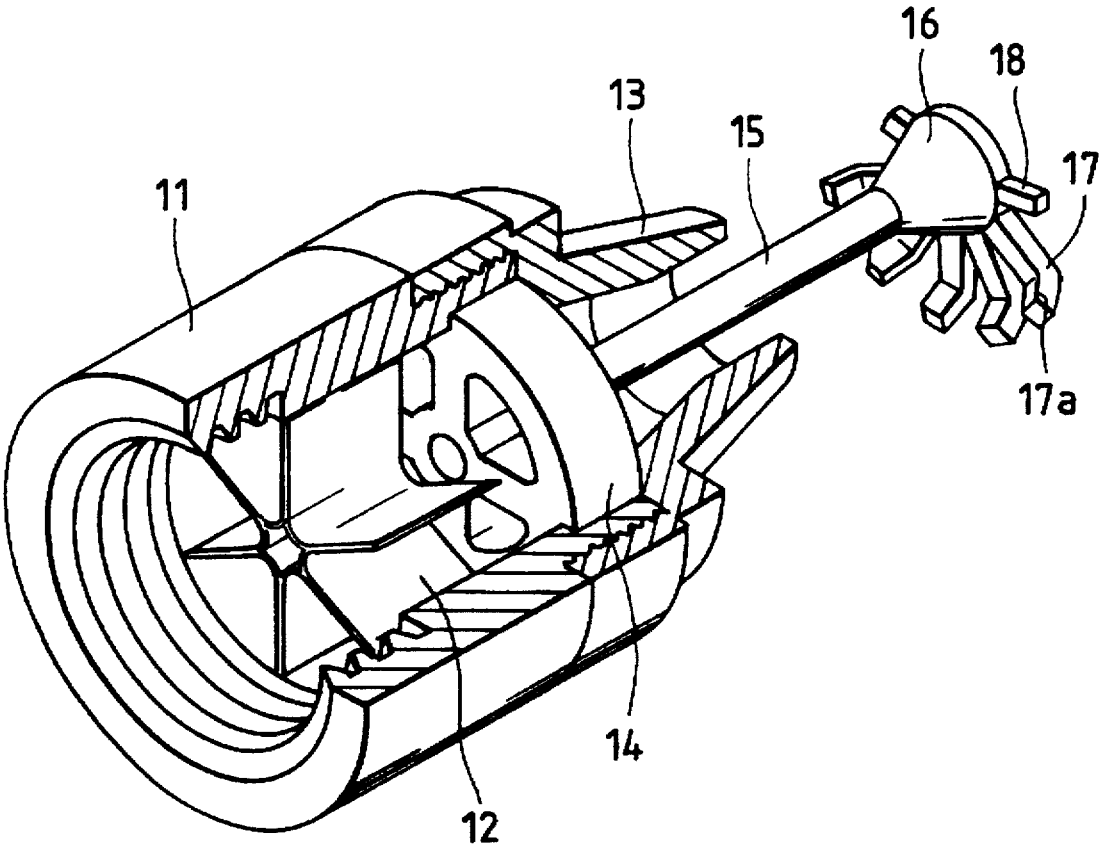
FIG. 30 PRIOR ART
FIG. 30 is a perspective view showing a conventional short-range water-discharging nozzle.

As illustrated in FIGS. 27 to 29, a ball-shaped hollow portion 2*a* is formed inside of the ball-shaped portion. The nozzle holes, as in the structure of FIG. 18, are formed along a center line of the ball-shaped portion 1*b* extending in a given direction.

The short-range water-discharging nozzle shown in FIGS. 22 through 29, as in the first embodiment shown in FIG. 17, can also secure the square, effective water-sprinkling area 30 of 18 m long (water discharging distance L) and 4 m wide (width W) as shown in FIG. 21 by using the long-range, the medium-range, and the very short-range water-discharging nozzle holes of which the arrays, the number of nozzle holes, and hole diameters are properly selected. As already referred to, those nozzle holes, radially directed, are formed in the ball-shaped portion 1*b* of the tubular nozzle body 1*a*.

It is evident that the particulars of the nozzle holes of the nozzle body are not limited to those of the above-mentioned embodiment. The discharging directions, the hole sizes, the number of holes, and the arrays of the nozzle holes may properly be determined depending the shape of a required short-range, effective water-sprinkling area. In the above-mentioned embodiment, the case where the ball-shaped water-discharging nozzle structure is solely installed was discussed. If required, the ball-shaped water-discharging nozzle structure may be used in combination with the long-range water-discharge nozzle. In this case, the former is used as the very short-range water-discharging nozzle. Further, the pressure to the water supplied to the long-range water-discharging nozzle is high. Accordingly, it is necessary to reduce the pressure soas to be adequate to the ball-shaped water-discharging nozzle structure of the invention.

What is claimed is:

1. A fire detecting/extinguishing apparatus comprising:

fire detecting means for monitoring to detect an occurrence of a fire within a monitoring area;

discharging means having a discharging nozzle for discharging a fire extinguishing agent to the monitoring area, said discharging means being rotatable in a horizontal direction;

swinging means for swinging said discharging means in the horizontal direction;

a casing receiving said fire detecting means and said discharging means therein; and a cover which is arranged to coincide with said casing to cover said discharging means when said discharging means is completely received in said casing, said cover being fixed to a side of said discharging means which is opposite to that for said discharging nozzle.

2. A fire detecting/extinguishing apparatus according to claim 1, wherein said cover rotates together with said discharging means; and wherein said cover is substantially flush with a front wall of said casing when said discharging means is received in said casing.

3. A fire detecting/extinguishing apparatus according to claim 2, further comprising control means for starting and controlling the swinging of said discharging means.

4. A fire detecting/extinguishing apparatus according to claim 3, further comprising scanning means for scanning said fire detecting means within the monitoring area in a direction and the horizontal direction to monitor the fire.

5. A fire detecting/extinguishing apparatus according to claim 4, further comprising position detecting means for detecting that a horizontal position of said fire detecting means coincides with a horizontal position of said discharging nozzle;

wherein, when said fire detecting means detects the occurrence of the fire, said control means stops at least the horizontal scanning of said fire detecting means and starts the swinging of said discharging means, and when said position detecting means detects that the horizontal position of said fire detecting means coincides with the horizontal position of said discharging nozzle, said control means stops the swinging of said discharging means to be directed toward a position of the fire.

6. A fire detecting/extinguishing apparatus according to claim 5, wherein said position detecting means includes a photointerrupter on a side of one of said fire detecting means and said discharging means, and a disc having an opening on a side of another of said fire detecting means and said discharging means, and wherein, when said photointerrupter detects the opening of said disc, said position detecting means judges that the horizontal position of said fire detecting means coincides with the horizontal position of said discharging nozzle.

7. A fire detecting/extinguishing apparatus according to claim 5, further comprising height setting means for setting a height where said fire detecting/extinguishing apparatus is installed; wherein a range corresponding to the height set by said height setting means is a fire judgment area of said apparatus.

8. A fire detecting/extinguishing apparatus according to claim 7, further comprising storing means for storing a table including a correspondence of the fire judgement area and the height where said apparatus is installed.

9. A fire detecting/extinguishing apparatus according to claim 5, wherein said discharging means swings coaxially and independently to said fire detecting means.

10. A fire detecting/extinguishing apparatus according to claim 5, wherein, when said position detecting means does not detect that the horizontal position of said fire detecting means coincides with the horizontal position of said discharging nozzle even if said discharging nozzle is swung a whole of the monitoring area, said control means controls the swinging of said discharging means.

11. A fire detecting/extinguishing apparatus according to claim 5, wherein, when said position detecting means does not detect that the horizontal position of said fire detecting means coincides with the horizontal position of said discharging nozzle even if said discharging nozzle is swung a whole of the monitoring area, a nozzle failure alarm is generated.

12. A fire detecting/extinguishing apparatus according to claim 4, wherein said control means calculates a position of the fire based on when said fire detecting means detects the fire; said control means starts the swinging of said discharging means when said fire detecting means detects the fire; and said control means directs said discharging nozzle toward the position of the fire based on the calculated position of the fire.

13. A fire detecting/extingusing apparatus according to claim 1, further comprising control means for starting and controlling the swinging of said discharging means.

14. A fire detecting/extinguishing apparatus according to claim 1, further comprising scanning means for scanning said fire detecting means within the monitoring area in a vertical direction and the horizontal direction to monitor the fire.

15. A fire detecting/extinguishing apparatus according to claim 1, wherein said discharging nozzle projects from a front wall of said casing when said discharging nozzle is directed toward a position of the fire.

16. A fire detecting/extinguishing apparatus according to claim 1, wherein said discharging nozzle comprises a hollow nozzle body having a supply port to which a supply pipe of pressurized fire extinguishing agent is connected, and a plurality of nozzle holes which is formed on a surface of said nozzle body, said surface directing toward a fire extinguishing agent discharging direction; and wherein at least a part of said surface on which said nozzle holes are formed is spherical.

17. A fire detecting/extinguishing apparatus according to claim 16, wherein said plurality of nozzle holes includes at least one long-range fire extinguishing agent discharging nozzle hole having an upward discharging angle, a plurality of medium-range discharging nozzle holes located under said long-range nozzle hole, and a plurality of very short-range discharging nozzle holes located under said medium-range discharging nozzle holes.

18. A fire detecting/extinguishing apparatus according to claim 17, wherein said discharging nozzle further comprises a nozzle tube which is provided for said long-range discharging nozzle hole.

19. A fire detecting/extinguishing apparatus according to claim 17, wherein said plurality of very short-range discharging nozzle holes includes a nozzle hole directed rearwardly and downwardly of the nozzle body.

20. A fire detecting/extinguishing apparatus according to claim 17, wherein said plurality of medium-range discharging nozzle holes includes at least a nozzle hole having an upwardly water discharging angle.

21. A fire detecting/extinguishing apparatus according to claim 17, wherein a diameter of said long-range nozzle hole is larger than a diameter of said medium-range nozzle holes, and the diameter of said medium-range nozzle holes is larger than a diameter of said very short-range nozzle holes.

22. A fire detecting/extinguishing apparatus according to claim 17, wherein a number of said very short-range nozzle holes is larger than a number of said medium-range nozzle holes, and the number of said medium-range nozzle holes is larger than a number of said long-range nozzle hole.

23. A fire detecting/extinguishing apparatus according to claim 16, wherein said discharging nozzle further comprises a spherical hollow portion formed at the top end of an inside of said nozzle body.

24. A fire detecting/extinguishing apparatus according to claim 1, wherein said cover rotates about a vertical axis of rotation about which said discharging means rotates when swinging in the horizontal direction.

25. A fire detecting/extinguishing apparatus according to claim 1, wherein said fire extinguishing agent is water.

26. A fire detecting/extinguishing apapratus according to claim 1, wherein said discharging means has a piping to which said discharging nozzle is connected, said cover is fixed to said piping, and said discharging means is rotatable in the horizontal direction about an axis being a vertical portion of said piping.

27. A fire detecting/extinguishing apparatus comprising:

fire detecting means for monitoring to detect an occurrence of a fire within a monitoring area;

discharging means having a discharging nozzle for discharging a first extinguishing agent to the monitoring area, said discharging means being rotatable in a horizontal direction;

swinging means for swinging said discharging means in the horizontal direction;

a casing receiving said fire detecting means and said discharging means therein;

a a cover which is arranged to coincide with said casing to cover said discharging means said discharging means is completely received in said casing; and scanning means for scanning said fire detecting means within the monitoring area in a vertical and the horizontal directions to monitor the fire;

wherein said scanning means has a swing portion having an opening window for monitoring the monitoring area and swinging means for horizontally swinging and controlling said swing portion;

a part of said swing portion including said opening window is disposed to slightly project from a front wall of said casing; and said scanning means performs the horizontal direction scanning of the monitoring area by the horizontal swinging of said swing portion.

28. A fire detecting/extinguishing apparatus according to claim 27, wherein said scanning means further has a mirror disposed at a position opposite to said opening window and rotating means for rotating said mirror in a vertical direction; and said scanning means performs the vertical direction scanning of the monitoring area by the vertical rotating of said rotating means.

29. A fire detecting/extinguishing apparatus according to claim 27, wherein said cover is fixed to a side of said discharging means which is opposite to that for said discharging nozzle, said cover being capable of rotating together with said discharging means;

and wherein said cover is substantially flush with a front wall of said casing when said discharging nozzle is received in said casing.

30. A fire detecting/extinguishing apparatus according to claim 27, further comprising control means for starting and controlling the swinging of said discharging means.

31. A fire detecting/extinguishing apparatus according to claim 27, further comprising position detecting means for detecting that a horizontal position of said fire detecting means coincides with a horizontal position of said discharging nozzle and control means for starting and stopping the swinging of said discharging means;

wherein, when said fire detecting means detects the occurrence of the fire, said control means stops at least the horizontal scanning of said fire detecting means and said control means starts the swinging of the discharging means, and when said position detecting means detects that the horizontal position of said fire detecting means coincides with the horizontal position of said discharging nozzle, said control means stops the swinging of said discharging means to be directed toward a position of the fire.

32. A fire detecting/extinguishing apparatus according to claim 31, wherein said position detecting means includes a photointerrupter on a side of one of said fire detecting means and said discharging means, and a disc having an opening on a side of another of said fire detecting means and said discharging means, and wherein, when said photointerrupter detects the opening of said disc, said position detecting means judges that the horizontal position of said fire detecting means coincides with the horizontal position of said discharging means.

33. A fire detecting/extinguishing apparatus according to claim 31, wherein said discharging means swings coaxially and independently to said fire detecting means.

34. A fire detecting/extinguishing apparatus according to claim 27, wherein said discharging nozzle projects from a front wall of said casing when said discharging nozzle directs toward a position of the fire.

35. A fire detecting/extinguishing apparatus according to claim 27, wherein said cover rotates about a vertical axis of rotation about which said discharging means rotates when swinging in the horizontal direction.

36. A fire detecting/extinguishing apparatus according to claim 27, wherein said fire extinguishing agent is water.

* * * * *